US011623452B2

(12) United States Patent
Yamada

(10) Patent No.: US 11,623,452 B2
(45) Date of Patent: Apr. 11, 2023

(54) SYSTEM, SERVER, AND IMAGE PROCESSING APPARATUS

(71) Applicant: BROTHER KOGYO KABUSHIKI KAISHA, Nagoya (JP)

(72) Inventor: Takatsugu Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/465,160

(22) Filed: Sep. 2, 2021

(65) Prior Publication Data

US 2022/0097399 A1 Mar. 31, 2022

(30) Foreign Application Priority Data

Sep. 30, 2020 (JP) ..... JP2020-164983
Nov. 30, 2020 (JP) ..... JP2020-198921

(51) Int. Cl.
*B41J 2/175* (2006.01)
*G03G 15/00* (2006.01)

(52) U.S. Cl.
CPC ..... *B41J 2/17546* (2013.01); *B41J 2/1752* (2013.01); *B41J 2/17566* (2013.01); *G03G 15/55* (2013.01); *G03G 15/553* (2013.01); *B41J 2002/17589* (2013.01)

(58) Field of Classification Search
CPC .. B41J 2/17509; B41J 2/1752; B41J 2/17546; B41J 2/17566; B41J 2002/17589; G03G 15/55; G03G 15/553
See application file for complete search history.

(56) References Cited

U.S. PATENT DOCUMENTS 6,233,409 B1 * 5/2001 Haines ..... G03G 15/0865 399/10
2016/0292550 A1 10/2016 Kawai
2016/0292774 A1 10/2016 Ohara
2019/0283439 A1 9/2019 Komine
2019/0286038 A1 * 9/2019 Seki ..... H04N 1/2346

FOREIGN PATENT DOCUMENTS

JP 2016-193592 A 11/2016
JP 2017-54155 A 3/2017
JP 2019-155742 A 9/2019
JP 2020-102254 A 7/2020

* cited by examiner

*Primary Examiner* — Anh T Vo
(74) *Attorney, Agent, or Firm* — Scully, Scott, Murphy & Presser, PC

(57) ABSTRACT

An apparatus controller performs: updating a number of mounting stored in an apparatus memory when a new consumable is mounted on an image processing apparatus; updating a life stored in the apparatus memory in response to execution of image processing; and transmitting, at a particular timing, the number of mounting and the life to a server. A server controller performs: in response to receiving the number of mounting and the life, not placing an order for the new consumable when the number of mounting is larger than a number of orders or the life is longer than or equal to a particular value, and placing the order for the new consumable when the number of mounting is smaller than or equal to the number of orders and the life is shorter than the particular value; and when the order is placed, updating the number of orders in a server memory.

24 Claims, 15 Drawing Sheets

FIG. 7

| | USER | NOTIFICATION | INK REMAINING AMOUNT INFORMATION | NUMBER OF ORDERS | |
|---|---|---|---|---|---|
| P1 | REGISTER IMAGE PROCESSING APPARATUS 1 FOR SERVICE | YES | | 0 | SHIP STARTER KIT |
| P2 | MOUNT CONTRACT CARTRIDGE 4A IN STARTER KIT | | | 1 | |
| P3 | PRINT | | | | |
| P4 | REGULAR NOTIFICATION | YES | FULL | 1 | NOT ORDER BECAUSE INK IS FULL |
| P5 | PRINT | | | | |
| P6 | REGULAR NOTIFICATION | YES | LOW | 1 | ORDER CONTRACT CARTRIDGE 4B |
| P7 | MOUNT CONTRACT CARTRIDGE 4A | | | 2 | |
| P8 | REGULAR NOTIFICATION | YES | LOW | 2 | ORDER CONTRACT CARTRIDGE 4C |
| P9 | MOUNT CONTRACT CARTRIDGE 4A | | | 3 | |
| P10 | REGULAR NOTIFICATION | YES | LOW | 3 | ORDER CONTRACT CARTRIDGE 4D |
| P11 | MOUNT CONTRACT CARTRIDGE 4A | | | 4 | |
| ⋮ | ⋮ | ⋮ | ⋮ | ⋮ | ⋮ |

FIG. 8

| | USER | NOTIFICATION | NUMBER OF DETECTIONS OF NEW CONSUMABLE | INK REMAINING AMOUNT INFORMATION | NUMBER OF ORDERS | |
|---|---|---|---|---|---|---|
| P21 | REGISTER IMAGE PROCESSING APPARATUS 1 FOR SERVICE | YES | 0 | | 0 | SHIP STARTER KIT |
| P22 | MOUNT CONTRACT CARTRIDGE 4A IN STARTER KIT | YES | 1 | FULL | 1 | NOT ORDER BECAUSE INK IS FULL |
| P23 | PRINT | | | | | |
| P24 | REGULAR NOTIFICATION | YES | 1 | FULL | 1 | NOT ORDER BECAUSE INK IS FULL |
| P25 | PRINT | | | | | |
| P26 | REGULAR NOTIFICATION | YES | 1 | LOW | 1 | ORDER CONTRACT CARTRIDGE 4B |
| P27 | MOUNT CONTRACT CARTRIDGE 4B | YES | 2 | FULL | 2 | NOT ORDER BECAUSE INK IS FULL |
| P28 | MOUNT CONTRACT CARTRIDGE 4A | YES | 2 | LOW | 2 | ORDER CONTRACT CARTRIDGE 4C |
| P29 | MOUNT CONTRACT CARTRIDGE 4B | YES | 2 | FULL | 3 | NOT ORDER BECAUSE NUMBER OF DETECTIONS OF NEW CONSUMABLE IS SMALLER THAN NUMBER OF ORDERS |
| P30 | MOUNT CONTRACT CARTRIDGE 4A | YES | 2 | LOW | 3 | NOT ORDER BECAUSE NUMBER OF DETECTIONS OF NEW CONSUMABLE IS SMALLER THAN NUMBER OF ORDERS |

FIG. 9

| | USER | NOTIFICATION | INK REMAINING AMOUNT INFORMATION | NUMBER OF ORDERS | |
|---|---|---|---|---|---|
| P41 | REGISTER IMAGE PROCESSING APPARATUS 1 FOR SERVICE | YES | | 0 | SHIP STARTER KIT |
| P42 | MOUNT INK CARTRIDGE IN STARTER KIT (CONTRACT CARTRIDGE) | | | 1 | |
| P43 | PRINT | | | | |
| P44 | REGULAR NOTIFICATION | YES | FULL | 1 | NOT ORDER BECAUSE INK IS FULL |
| P45 | PRINT | | | | |
| P46 | INK EMPTY | | | | |
| P47 | MOUNT COMMERCIAL CARTRIDGE | | | | |
| P48 | PRINT | | | | |
| P49 | REGULAR NOTIFICATION (TRANSMIT INFORMATION ON COMMERCIAL CARTRIDGE) | YES | LOW | 1 | NOT ORDER BECAUSE MOUNTED CARTRIDGE IS COMMERCIAL CARTRIDGE (OCCURRENCE OF ORDER OMISSION) |
| ⋮ | ⋮ | ⋮ | ⋮ | ⋮ | ⋮ |

FIG. 10

| | USER | NOTIFICATION | NUMBER OF DETECTIONS OF NEW CONSUMABLE | INK REMAINING AMOUNT INFORMATION | NUMBER OF ORDERS | |
|---|---|---|---|---|---|---|
| P51 | REGISTER IMAGE PROCESSING APPARATUS 1 FOR SERVICE | YES | 0 | | 1 | SHIP STARTER KIT |
| P52 | MOUNT INK CARTRIDGE IN STARTER KIT (CONTRACT CARTRIDGE) | YES | 1 | FULL | 1 | NOT ORDER BECAUSE INK IS FULL |
| P53 | PRINT | | | | | |
| P54 | REGULAR NOTIFICATION | YES | 1 | FULL | 1 | NOT ORDER BECAUSE INK IS FULL |
| P55 | PRINT | | | | | |
| P56 | INK EMPTY | | | | | |
| P57 | MOUNT COMMERCIAL CARTRIDGE (TRANSMIT INFORMATION ON CONTRACT CARTRIDGE) | YES | 1 | EMPTY | 1 | ORDER NEW CONTRACT CARTRIDGE |
| ⋮ | ⋮ | ⋮ | ⋮ | ⋮ | ⋮ | ⋮ |

FIG. 12

| | USER | NOTIFICATION | INK REMAINING AMOUNT INFORMATION | NUMBER OF ORDERS | |
|---|---|---|---|---|---|
| P101 | REGISTER IMAGE PROCESSING APPARATUS 1A FOR SERVICE | YES | | 0 | SHIP STARTER KIT |
| P102 | MOUNT INK CARTRIDGE IN STARTER KIT (CONTRACT CARTRIDGE) | | | 1 | |
| P103 | PRINT | | | | |
| P104 | REGULAR NOTIFICATION | YES | FULL | 1 | NOT ORDER BECAUSE INK IS FULL |
| P105 | PRINT | | | | |
| P106 | REGULAR NOTIFICATION | YES | LOW | 1 | ORDER CONTRACT CARTRIDGE 4A |
| P107 | MOUNT CONTRACT CARTRIDGE 4A | | | 2 | |
| P108 | PRINT | | | | |
| P109 | MOUNT CONTRACT CARTRIDGE 4B OF IMAGE PROCESSING APPARATUS 1B | | | 2 | |
| P110 | PRINT | | | | |
| P111 | REGULAR NOTIFICATION | YES | LOW | 2 | ORDER NEW CONTRACT CARTRIDGE (OCCURRENCE OF MULTIPLE ORDERS) |
| : | : | : | : | : | : |

FIG. 13

| | USER | NOTIFICATION | NUMBER OF DETECTIONS OF NEW CONSUMABLE | INK REMAINING AMOUNT INFORMATION | NUMBER OF ORDERS | |
|---|---|---|---|---|---|---|
| P121 | REGISTER IMAGE PROCESSING APPARATUS 1A FOR SERVICE | YES | 0 | | 0 | SHIP STARTER KIT |
| P122 | MOUNT INK CARTRIDGE IN STARTER KIT (CONTRACT CARTRIDGE) | YES | 1 | FULL | 1 | NOT ORDER BECAUSE INK IS FULL |
| P123 | PRINT | | | | | |
| P124 | REGULAR NOTIFICATION | YES | 1 | FULL | 1 | NOT ORDER BECAUSE INK IS FULL |
| P125 | PRINT | | | | | |
| P126 | REGULAR NOTIFICATION | YES | 1 | LOW | 1 | ORDER CONTRACT CARTRIDGE 4A |
| P127 | MOUNT CONTRACT CARTRIDGE 4A | YES | 2 | FULL | 2 | NOT ORDER BECAUSE INK IS FULL |
| P128 | PRINT | | | | | |
| P129 | MOUNT CONTRACT CARTRIDGE 4B OF IMAGE PROCESSING APPARATUS 1B | YES | 3 | FULL | 2 | NOT ORDER BECAUSE NUMBER OF DETECTIONS OF NEW CONSUMABLE IS LARGER THAN NUMBER OF ORDERS |
| P130 | PRINT | | | | | |
| P131 | REGULAR NOTIFICATION | YES | 3 | LOW | 2 | NOT ORDER BECAUSE NUMBER OF DETECTIONS OF NEW CONSUMABLE IS LARGER THAN NUMBER OF ORDERS |
| P132 | MOUNT CONTRACT CARTRIDGE 4A | YES | 3 | LOW | 2 | NOT ORDER BECAUSE NUMBER OF DETECTIONS OF NEW CONSUMABLE IS LARGER THAN NUMBER OF ORDERS |
| : | : | : | : | : | : | : |

FIG. 14

| | USER | NOTIFICATION | INK REMAINING AMOUNT INFORMATION | NUMBER OF ORDERS | |
|---|---|---|---|---|---|
| P141 | REGISTER IMAGE PROCESSING APPARATUS 1A FOR SERVICE | YES | | 0 | SHIP STARTER KIT |
| P142 | MOUNT INK CARTRIDGE IN STARTER KIT (CONTRACT CARTRIDGE) | | | 1 | |
| P143 | PRINT | | | | |
| P144 | REGULAR NOTIFICATION | YES | FULL | 1 | NOT ORDER BECAUSE INK IS FULL |
| P145 | PRINT | | | | |
| P146 | INK EMPTY | | | | |
| P147 | MOUNT COMMERCIAL CARTRIDGE | | | | |
| P148 | PRINT | | | | |
| P149 | REGULAR NOTIFICATION (TRANSMIT INFORMATION ON COMMERCIAL CARTRIDGE) | YES | LOW | 1 | NOT ORDER BECAUSE MOUNTED CARTRIDGE IS COMMERCIAL CARTRIDGE (OCCURRENCE OF ORDER OMISSION) |
| ⋮ | ⋮ | ⋮ | ⋮ | ⋮ | ⋮ |

FIG. 15

| | USER | NOTIFICATION | NUMBER OF DETECTIONS OF NEW CONSUMABLE | INK REMAINING AMOUNT INFORMATION | NUMBER OF ORDERS | |
|---|---|---|---|---|---|---|
| P151 | REGISTER IMAGE PROCESSING APPARATUS 1A FOR SERVICE | YES | 0 | | 1 | SHIP STARTER KIT |
| P152 | MOUNT INK CARTRIDGE IN STARTER KIT (CONTRACT CARTRIDGE) | YES | 1 | FULL | 1 | NOT ORDER BECAUSE INK IS FULL |
| P153 | PRINT | | | | | |
| P154 | REGULAR NOTIFICATION | YES | 1 | FULL | 1 | NOT ORDER BECAUSE INK IS FULL |
| P155 | PRINT | | | | | |
| P156 | INK EMPTY | | | | | |
| P157 | MOUNT COMMERCIAL CARTRIDGE (TRANSMIT INFORMATION ON CONTRACT CARTRIDGE) | YES | 1 | EMPTY | 1 | ORDER NEW CONTRACT CARTRIDGE |
| ⋮ | ⋮ | ⋮ | ⋮ | ⋮ | ⋮ | ⋮ |

SYSTEM, SERVER, AND IMAGE PROCESSING APPARATUS

CROSS REFERENCE TO RELATED APPLICATIONS

This application claims priority from Japanese Patent Applications No. 2020-164983 filed Sep. 30, 2020 and No. 2020-198921 filed Nov. 30, 2020. The entire content of each of the priority applications is incorporated herein by reference.

BACKGROUND

There is a service that a user contracts with a business operator and is allowed to use contract-specific consumables or replacements in image processing apparatuses such as printers. Such services are called "subscription services".

For example, there are known printers to which subscription services apply. A dedicated ink cartridge is delivered to the user who has subscribed to the subscription service, and after that, when the ink remaining amount falls below a threshold due to the use of the printer, the server places an order and a new dedicated ink cartridge is delivered to the user.

SUMMARY

According to one aspect, this specification discloses a system. The system includes an image processing apparatus and a server. The server is connected to the image processing apparatus through a network so as to perform communication with the image processing apparatus. The server is configured to provide a service of managing a consumable used in the image processing apparatus. The image processing apparatus includes an image processing device, an apparatus interface, an apparatus memory, and an apparatus controller. The image processing device is configured to perform image processing by using the consumable mounted on the image processing apparatus. The apparatus interface is for connecting to the network. The apparatus memory is configured to store a number of mounting of a new consumable and a life of the consumable mounted on the image processing apparatus. The new consumable is an unused consumable. The apparatus controller is configured to perform: updating the number of mounting stored in the apparatus memory when the new consumable is mounted on the image processing apparatus; updating the life stored in the apparatus memory in response to execution of the image processing; and transmitting, at a particular timing, the number of mounting and the life stored in the apparatus memory through the apparatus interface to the server. The server includes a server interface, a server memory, and a server controller. The server interface is for connecting to the network. The server memory is configured to store a number of orders of the new consumable. The server controller is configured to perform: in response to receiving, through the server interface, the number of mounting and the life, not placing an order for the new consumable when the number of mounting is larger than the number of orders or the life is longer than or equal to a particular value, and placing the order for the new consumable when the number of mounting is smaller than or equal to the number of orders and the life is shorter than the particular value; and when the order is placed, updating the number of orders stored in the server memory.

According to another aspect, this specification also discloses a server configured to provide a service of managing a consumable used in an image processing apparatus. The server includes an interface, a memory, and a controller. The interface is for connecting to the image processing apparatus through a network so as to perform communication with the image processing apparatus. The memory is configured to store a number of orders of a new consumable. The new consumable is an unused consumable. The controller is configured to perform: in response to receiving, through the interface, a number of mounting of the new consumable on the image processing apparatus and a life of the consumable mounted on the image processing apparatus transmitted from the image processing apparatus, not placing an order for the new consumable when the number of mounting is larger than the number of orders or the life is longer than or equal to a particular value, and placing the order for the new consumable when the number of mounting is smaller than or equal to the number of orders and the life is shorter than the particular value; and when the order is placed, updating the number of orders stored in the memory.

According to still another aspect, this specification also discloses a system. The system includes an image processing apparatus and a server. The server is connected to the image processing apparatus through a network so as to perform communication with the image processing apparatus. The server is configured to provide a service of managing a consumable used in the image processing apparatus. The consumable includes a managed consumable managed by the server and an unmanaged consumable not managed by the server. The server includes a server interface and a server controller. The server interface is for connecting to the network. The server controller is configured not to place an order of the managed consumable based on a life of the unmanaged consumable and to place the order of the managed consumable based on a life of the managed consumable. The image processing apparatus includes an image processing device, an apparatus interface, an apparatus memory, and an apparatus controller. The image processing device is configured to perform image processing by using the consumable mounted on the image processing apparatus. The apparatus interface is for connecting to the network. The apparatus memory is configured to store the life of the consumable mounted on the image processing apparatus. The apparatus controller is configured to perform: when the managed consumable is mounted on the image processing apparatus, updating the life of the managed consumable stored in the apparatus memory in response to execution of the image processing; and transmitting, at a particular timing, at least the life of the managed consumable stored in the apparatus memory through the apparatus interface to the server.

According to still another aspect, this specification also discloses an image processing apparatus. The image processing apparatus is configured such that a managed consumable managed by a server and an unmanaged consumable not managed by the server are mountable thereon as a consumable. The image processing apparatus includes an interface, an image processing device, a memory, and a controller. The interface is for connecting to the server so as to perform communication with the server. The image processing device is configured to perform image processing by using the consumable mounted on the image processing apparatus. The memory is configured to store a life of the consumable mounted on the image processing apparatus. The controller is configured to perform: when the managed consumable is mounted on the image processing apparatus, updating the life of the managed consumable stored in the memory in response to execution of the image processing; and transmitting, at a particular timing, at least the life of the managed consumable stored in the memory through the interface to the server.

According to still another aspect, this specification also discloses a system. The system includes an image processing apparatus and a server. The server is connected to the image processing apparatus through a network so as to perform communication with the image processing apparatus. The server is configured to provide a service of managing a consumable used in the image processing apparatus. The image processing apparatus includes an image processing device, an apparatus interface, an apparatus memory, and an apparatus controller. The image processing device is configured to perform image processing by using the consumable mounted on the image processing apparatus. The apparatus interface is for connecting to the network. The apparatus memory is configured to store a number of mounting of a new consumable and a life of the consumable mounted on the image processing apparatus. The new consumable is an unused consumable. The apparatus controller is configured to perform: updating the number of mounting stored in the apparatus memory when the new consumable is mounted on the image processing apparatus; updating the life stored in the apparatus memory in response to execution of the image processing; and transmitting, at a particular timing, the number of mounting and the life stored in the apparatus memory through the apparatus interface to the server. The server includes a server interface, a server memory, and a server controller. The server interface is for connecting to the network. The server memory is configured to store a number of orders of the new consumable. The server controller is configured to perform: in response to receiving, through the server interface, the number of mounting and the life transmitted from the image processing apparatus, not placing an order for the new consumable when a magnitude relationship between the number of mounting and the number of orders satisfies a first condition or the life is longer than or equal to a particular value, and placing the order for the new consumable when the magnitude relationship satisfies a second condition different from the first condition and the life is shorter than the particular value; and when the order is placed, updating the number of orders stored in the server memory.

According to still another aspect, this specification also discloses a server. The server is configured to provide a service of managing a consumable used in an image processing apparatus. The server includes an interface, a memory, and a controller. The interface is for connecting to the image processing apparatus through a network so as to perform communication with the image processing apparatus. The memory is configured to store a number of orders of a new consumable. The new consumable is an unused consumable. The controller is configured to perform: in response to receiving, through the interface, a number of mounting of the new consumable on the image processing apparatus and a life of the consumable mounted on the image processing apparatus transmitted from the image processing apparatus, not placing an order for the new consumable when a magnitude relationship between the number of mounting and the number of orders satisfies a first condition or the life is longer than or equal to a particular value, and placing the order for the new consumable when the magnitude relationship satisfies a second condition different from the first condition and the life is shorter than the particular value; and when the order is placed, updating the number of orders stored in the memory.

BRIEF DESCRIPTION OF THE DRAWINGS

Embodiments in accordance with this disclosure will be described in detail with reference to the following figures wherein:

FIG. 7 is a diagram showing an example of the flow of order management in an order management system of a comparative example;

FIG. 8 is a diagram showing an example of the flow of order management in an order management system according to the first embodiment;

FIG. 9 is a diagram showing an example of the flow of order management in the order management system of the comparative example;

FIG. 10 is a diagram showing an example of the flow of order management in the order management system according to the first embodiment;

FIG. 12 is a diagram showing an example of the flow of order management in an order management system of a comparative example;

FIG. 13 is a diagram showing an example of the flow of order management in an order management system according to the second embodiment;

FIG. 14 is a diagram showing an example of the flow of order management in the order management system of the comparative example; and FIG. 15 is a diagram showing an example of the flow of order management in the order management system according to the second embodiment.

DETAILED DESCRIPTION

There is room for improvement in the above technology from the viewpoint of preventing mistakes in ordering consumables. An ordering mistake is, for example, "multiple ordering" in which an order for more consumables than an appropriate amount is ordered, or "order omission" in which an order is not placed in a situation where an order should be placed.

In view of the foregoing, an aspect of an objective of this disclosure is to suppress mistakes in ordering consumables in subscription services for an image processing apparatus.

Hereinafter, embodiments of this disclosure will be described below with reference to the drawings.

An image processing apparatus 1 according to this embodiment is an image processing apparatus for which a user of the image processing apparatus 1 is allowed to use a consumable dedicated to the contract by contracting with a business operator. That is, the image processing apparatus 1 according to this embodiment is an image processing apparatus to which a subscription service can be applied.

Hereinafter, unless otherwise specified, the image processing apparatus 1 is an image processing apparatus that has subscribed (that is, has a contract) to a subscription service.

As an example in this embodiment, the image processing apparatus 1 is an inkjet printer. However, the image processing apparatus 1 may be a printer other than an inkjet printer. For example, the image processing apparatus 1 may be a laser printer. The image processing apparatus 1 may be an image processing apparatus other than the printer. For example, the image processing apparatus 1 may be a scanner.

<Overall Configuration of Image Processing Apparatus>

The outline of the structure of the image processing apparatus 1 will be described with reference to FIG. 1. For convenience, in the following description, the upper side of FIG. 1 is the upper side of the image processing apparatus 1, the lower side of FIG. 1 is the lower side of the image processing apparatus 1, the left side of FIG. 1 is the rear side of the image processing apparatus 1, and the right side of FIG. 1 is the front side of the image processing apparatus 1.

The image processing apparatus 1 is an inkjet printer that prints an image based on data on a printing sheet P by ejecting ink. One or more ink cartridges are mounted on the main housing of the image processing apparatus 1. In addition to the members shown in FIG. 1, the image processing apparatus 1 may be provided with a display such as a liquid crystal display or a lamp, and an input interface such as a button. The liquid crystal display may be configured to function as an input interface by being integrally formed with a touch panel.

Figure 1:
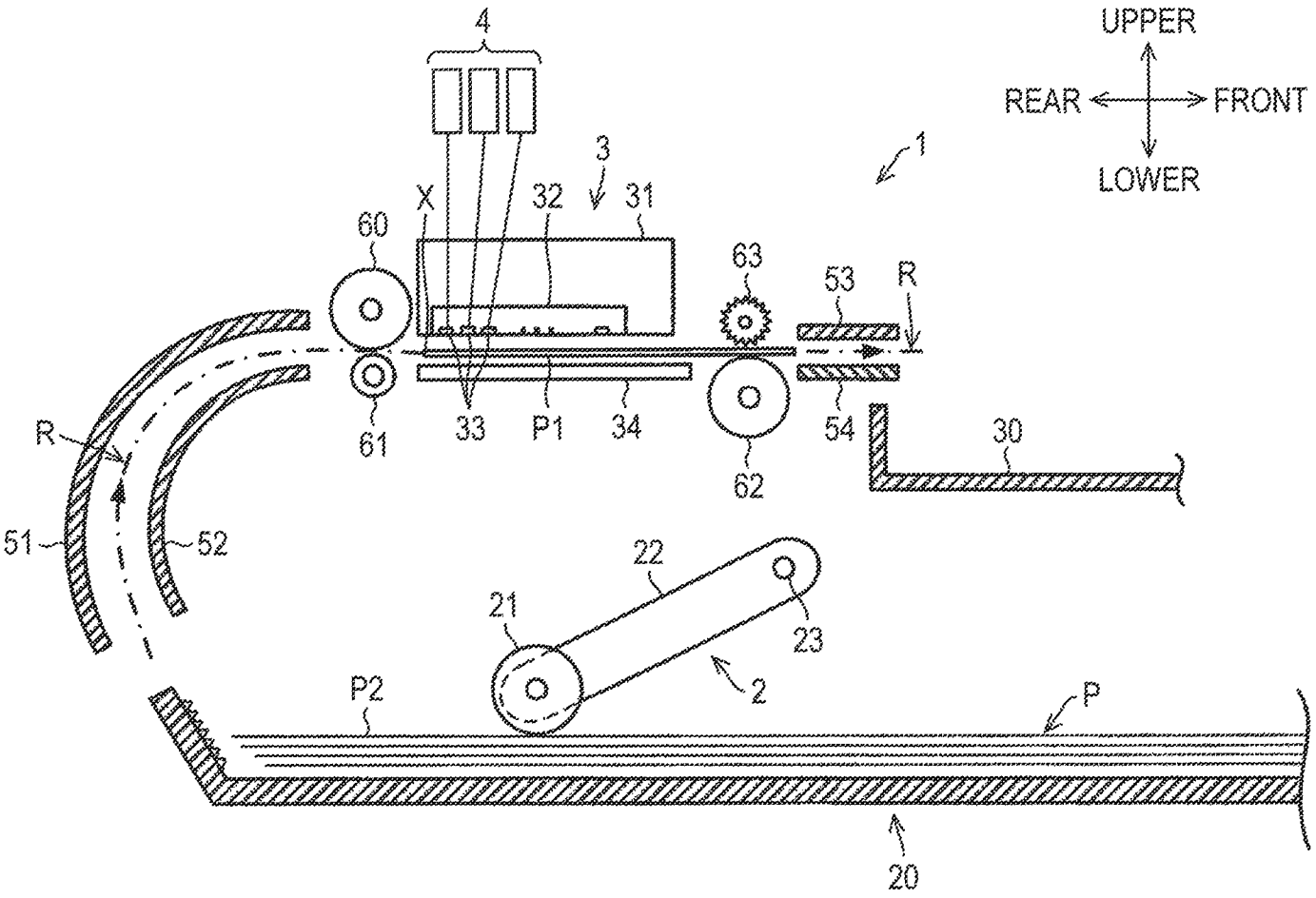
FIG. 1 is a diagram showing the outline of the configuration of an image processing apparatus included in an order management system according to embodiments.

In the example of FIG. 1, the image processing apparatus 1 includes a paper feed tray 20, a paper feed unit 2, a conveyance roller 60, a recording unit 3, a discharge roller 62, and a discharge tray 30. An opening is formed on the front surface of the image processing apparatus 1. The paper feed tray 20 is arranged in the opening so as to be movable in the front-rear direction. The paper feed tray 20 accommodates a plurality of stacked printing sheets P. The printing sheet P is, for example, a paper having a particular size. The printing sheet P is not limited to a paper medium. For example, the printing sheet P may be a resin material such as an OHP sheet.

The paper feed unit 2 includes a paper feed roller 21, a paper feed arm 22, and a shaft 23. The paper feed unit 2 feeds the printing sheet P accommodated in the paper feed tray 20 to a conveyance path R by the forward rotation of the paper feed roller 21. The paper feed roller 21 is rotatably provided at the distal end of the paper feed arm 22. The paper feed arm 22 is rotatably provided at the shaft 23 supported by the frame of the image processing apparatus 1. The paper feed arm 22 is rotationally urged toward the paper feed tray 20 by its own weight or an urging force generated by a spring and so on. The driving force due to the reverse rotation of a motor (not shown) provided in the image processing apparatus 1 is transmitted to the paper feed roller 21, so that the paper feed roller 21 rotates in the forward direction.

The conveyance path R is a space formed by a guide member 51, a guide member 52, the recording unit 3, a guide member 53, a guide member 54, and so on.

The conveyance roller 60 is arranged at the upstream side of the recording unit 3 in the conveyance direction. The pinch roller 61 is arranged so as to face the lower part of the conveyance roller 60. The conveyance roller 60 is rotated by the power of the motor of the image processing apparatus 1. The pinch roller 61 rotates due to rotation of the conveyance roller 60. When the conveyance roller 60 and the pinch roller 61 rotate in the forward direction, the printing sheet P is conveyed to an image recording position X on the conveyance path R in a state where the printing sheet P is sandwiched between the conveyance roller 60 and the pinch roller 61. The image recording position X is a position where the recording head 32 records an image on the printing sheet P. When the driving force due to the forward rotation of the motor of the image processing apparatus 1 is transmitted to the conveyance roller 60, the conveyance roller 60 rotates in the forward direction. When the driving force due to the reverse rotation of the motor is transmitted to the conveyance roller 60, the conveyance roller 60 rotates in the reverse direction.

The recording unit 3 is arranged between the conveyance roller 60 and the discharge roller 62 of the conveyance path R. The recording unit 3 includes a carriage 31, a recording head 32, a plurality of nozzles 33, and a platen 34. Each of the nozzles 33 is connected to an ink cartridge 4. The number of nozzles 33 and ink cartridges 4 is not particularly limited.

The ink cartridge 4 has a cartridge housing. The cartridge housing is attachable to the main housing of the image processing apparatus 1. The ink cartridges 4 store ink of different colors (for example, cyan, magenta, yellow, and black) as materials used for performing image processing (image formation). Ink is an example of a consumable that is consumed each time printing is performed.

The carriage 31 reciprocates in a direction perpendicular to the conveyance direction, that is, in the width direction of the printing sheet P. In the image recording of the printing sheet P, as recording processing, in a state where conveyance of the printing sheet P is stopped, the image processing apparatus 1 moves the carriage 31 in the width direction of the printing sheet P and ejects ink from the nozzles 33 of the recording head 32, thereby recording an image for one line on the printing sheet P. As line feed processing, the image processing apparatus 1 drives the conveyance roller 60 and the discharge roller 62 to convey the printing sheet P by a particular line feed amount. The image processing apparatus 1 repeats the recording processing and the line feed processing.

As shown in FIG. 1, the recording head 32 is mounted on the carriage 31. The plurality of nozzles 33 are provided on the lower surface of the recording head 32. The recording head 32 ejects ink droplets from the nozzles 33. The platen 34 is a rectangular plate-shaped member on which the printing sheet P is placed. The recording head 32 selectively ejects ink droplets in the process of moving the carriage 31 relative to the printing sheet P supported by the platen 34, thereby recording an image on the printing sheet P.

The discharge roller 62 is arranged at the downstream side of the recording unit 3 in the conveyance direction. A spur 63 is arranged at a position facing the upper part of the discharge roller 62. The discharge roller 62 is driven by a motor provided in the image processing apparatus 1. The spur 63 rotates due to the rotation of the discharge roller 62. When the discharge roller 62 and the spur 63 rotate in the forward direction, the printing sheet P is sandwiched between the discharge roller 62 and the spur 63 and discharged to the discharge tray 30.

The discharge tray 30 is arranged above the paper feed tray 20. The discharge tray 30 supports the printing sheet P discharged by the discharge roller 62.

<Internal Configuration of Image Processing Apparatus 1, Ink Cartridge 4, and Management Server 9>

Figure 2:
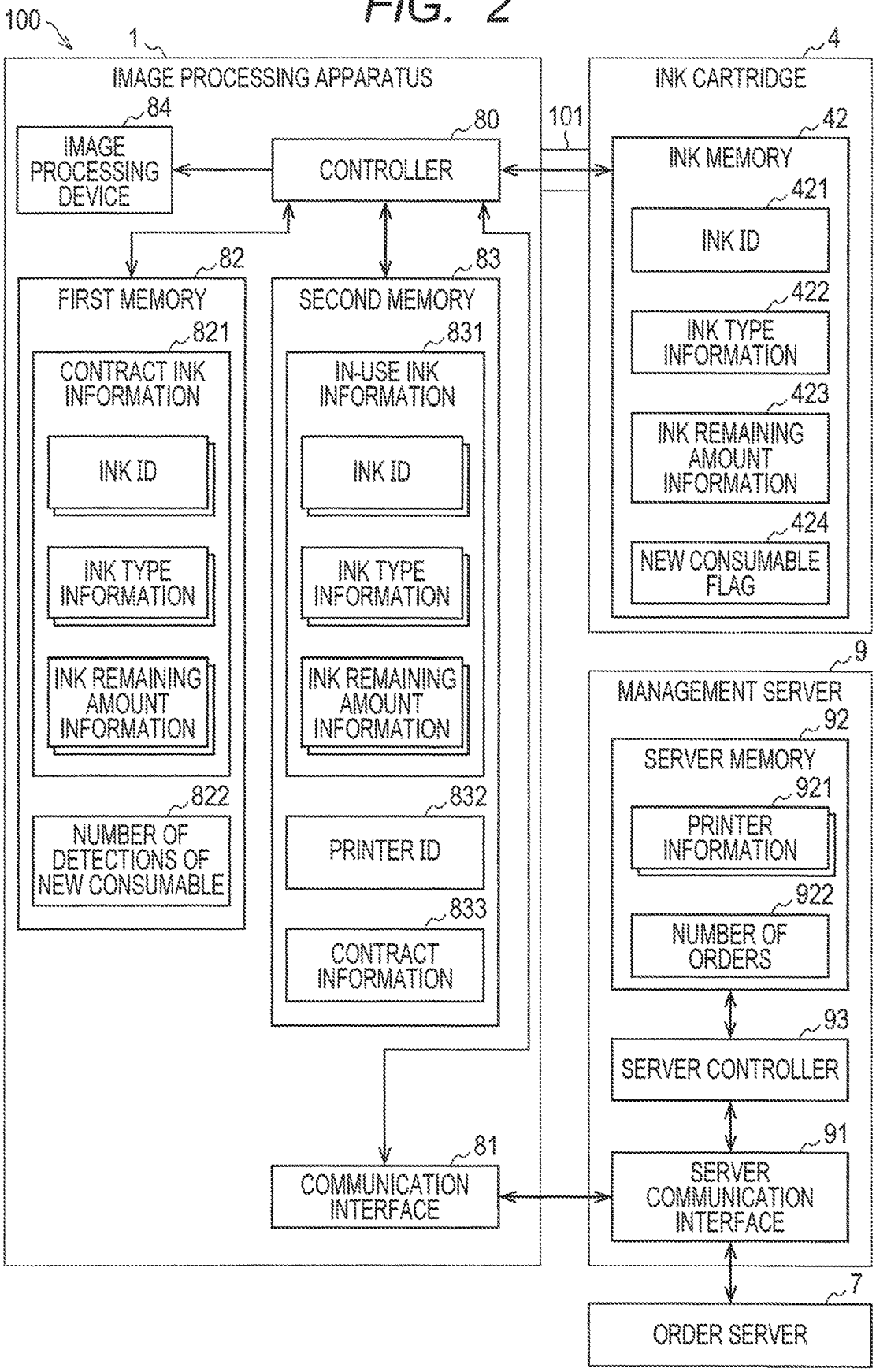
FIG. 2 is a block diagram showing the main configuration of the image processing apparatus, an ink cartridge, and a management server in the embodiment.

As shown in FIG. 2, the ink cartridge 4 includes an ink memory 42. The ink memory 42 is a memory in which reading and writing of information is possible. The ink memory 42 is, for example, a flash ROM or EEPROM™.

The ink memory 42 stores an ink ID 421, ink type information 422, ink remaining amount information 423, and a new consumable flag 424.

The ink ID 421 is, for example, a unique serial number for identifying each ink cartridge 4.

The ink type information 422 is information indicating whether the ink cartridge 4 is a contract-dedicated ink cartridge (managed consumable) or a normal ink cartridge (unmanaged consumable). The "contract-dedicated ink cartridge" is an ink cartridge supplied by a business operator to a user who has a contract with the business operator for the image processing apparatus 1. A "normal ink cartridge" is a cartridge other than a contract-dedicated ink cartridge. For example, the normal cartridge may be an ink cartridge sold in a general store. Hereinafter, the contract-dedicated ink cartridge may be referred to as a "contract cartridge", and the normal ink cartridge may be referred to as a "commercial cartridge".

The ink remaining amount information 423 is information indicating the remaining amount of the ink cartridge 4. The ink remaining amount information 423 is information indicating the life of the ink cartridge 4 which is consumable. The ink remaining amount information 423 may indicate the remaining amount of the ink cartridge 4 as a ratio with respect to the maximum value. Alternatively, the ink remaining amount information 423 may indicate which of particular numerical ranges the remaining amount of the ink cartridge 4 is included in. The particular numerical ranges are, for example, three ranges of the remaining amount of the ink cartridge 4, which are a first range larger than or equal to a minimum value and smaller than a first value, a second range larger than or equal to the first value and smaller than a second value, and a third range larger than or equal to the second value and smaller than a maximum value. The first value is smaller than the second value. Hereinafter, regarding these three ranges, the first range may be referred to as "Empty", the second range may be referred to as "Low", and the third range may be referred to as "Full".

The new consumable flag 424 is information indicating whether the ink cartridge 4 is a new consumable which is an unused consumable or an old consumable which is a used consumable. The new consumable flag 424 indicates a new consumable before the ink cartridge 4 is mounted on the cartridge housing. Once the ink cartridge 4 is mounted on the cartridge housing, the new consumable flag 424 becomes information indicating an old consumable.

The main housing of the image processing apparatus 1 has a connector 101. When the ink cartridge 4 is mounted on the image processing apparatus 1, the connector 101 is electrically connected to the ink memory 42. As a result, the image processing apparatus 1 is ready to communicate with the ink memory 42 of the ink cartridge 4.

The image processing apparatus 1 includes a controller 80 (apparatus controller, controller), a communication interface 81 (apparatus interface, interface), a first memory 82 (apparatus memory, memory, first area), and a second memory 83 (second area).

The controller 80 has, for example, an ASIC (Application Specific Integrated Circuit). The controller 80 is electrically connected to the communication interface 81, the first memory 82, and the second memory 83 provided at the main housing of the image processing apparatus 1. The controller 80 causes an image processing device 84 to perform various processes related to printing by executing various processes.

The controller 80 may include a processor such as a CPU. In this case, a control program that realizes the control of the image processing apparatus 1 is stored in the first memory 82 or the second memory 83, and the processor operates according to the control program so that the controller 80 causes the image processing apparatus 1 to perform various processes.

The controller 80 may include a computer-readable storage medium that stores the control program. As the storage medium, a "non-transitory tangible medium", for example, a ROM (Read Only Memory) and so on, a tape, a disk, a card, a semiconductor memory, a programmable logic circuit, and so on may be used. A RAM (Random Access Memory) for expanding the control program may be used. The control program may be supplied to the computer through any transmission medium (communication network, broadcast wave, and so on) capable of transmitting the control program. One aspect of this disclosure may also be realized in the form of a data signal embedded in a carrier wave in which the control program is embodied by electronic transmission.

When the ink cartridge 4 is mounted on the image processing apparatus 1, as shown in FIG. 2, the ink cartridge 4 is electrically connected to the controller 80. Thus, the controller 80 is ready to execute a process of reading information from the ink memory 42 and a process of writing (including rewriting) information to the ink memory 42.

The first memory 82 and the second memory 83 are memories in which reading and writing of information is possible. The first memory 82 and the second memory 83 are, for example, NVRAM (Non-volatile RAM). The second memory 83 may be a memory other than NVRAM, for example, a flash ROM or an EEPROM™.

The first memory 82 stores contract ink information 821 and a number of detections of new consumable 822 (number of mounting). The second memory 83 stores used ink information 831, a printer ID 832, and contract information 833.

The printer ID 832 is identification information for identifying the image processing apparatus 1. The printer ID 832 is, for example, the serial number of the image processing apparatus 1.

The contract information 833 is information indicating the contract contents of the image processing apparatus 1. More specifically, the contract information 833 indicates whether the image processing apparatus 1 is contracted for the service. In this embodiment, the contract information 833 shows whether the image processing apparatus 1 is set to a contract mode or the image processing apparatus 1 is set to a normal mode (non-contract mode). The contract mode indicates that the image processing apparatus 1 is under contract. The normal mode indicates that the image processing apparatus 1 is not under contract. The contract information 833 may be rewritten through the management server 9 when the user of the image processing apparatus 1 changes the contract contents of the image processing apparatus 1.

When the image processing apparatus 1 is in the contract mode, a contract cartridge is usable and a commercial cartridge is also usable on the image processing apparatus 1. When the image processing apparatus 1 is in the normal mode, the contract cartridge is not usable but a commercial cartridge is usable on the image processing apparatus.

The used ink information 831 is information in which an ink ID read from the ink memory 42 of each ink cartridge 4, ink type information, and ink remaining amount information are associated with one another for each ink cartridge 4. The used ink information 831 is information on the ink cartridge 4 currently mounted on the image processing apparatus 1. That is, the ink cartridge 4 corresponding to the used ink information 831 may be a contract cartridge or a commercial cartridge.

The contract ink information 821 is information in which an ink ID read from the ink memory 42 of each ink cartridge 4, ink type information, and ink remaining amount information are associated with one another for each ink cartridge 4. The contract ink information 821 is information on the contract cartridge most recently mounted on the image processing apparatus 1. The "contract cartridge most recently mounted" also includes the "currently mounted contract cartridge".

The number of detections of new consumable 822 is the number of times that the contract cartridge of new consumable is mounted on a mount portion (not shown). That is, the number of detections of new consumable 822 is the number of times that the contract cartridge of which the new consumable flag 424 indicates new consumable is mounted on the mount portion. The number of detections of new consumable 822 is data for each type of ink cartridge 4, that is, for each color. For example, in a case where ink cartridges 4 of four colors of cyan, magenta, yellow, and black are mounted on the image processing apparatus 1, the number of detections of new consumable 822 corresponding to each of the ink cartridges 4 of the above four colors is stored in the first memory 82.

The communication interface 81 is for performing communication between the image forming apparatus 1 and the management server 9. As an example, the communication interface 81 transmits (notifies) the information acquired from the controller 80 to the management server 9.

The image processing device 84 operates in accordance with the instructions of the controller 80 in order to perform image processing, for example, various processes related to printing. The image processing device 84 corresponds to the motors and the recording unit 3 of the image processing apparatus 1 described with reference to FIG. 1.

The management server 9 is a management apparatus that manages one or more image processing apparatus 1, and also provides a service of managing consumables used in the image processing apparatus 1. In the example of FIG. 2, the management server 9 is connected to only one image processing apparatus 1, but the management server 9 may be connected to a plurality of image processing apparatuses 1 for communication.

The management server 9 includes a server communication interface 91 (server interface, interface), a server memory 92 (server memory, memory), and a server controller 93 (server controller, controller). The server communication interface 91 is a communication interface for performing communication between the management server 9 and the image processing apparatus 1. The server communication interface 91 outputs the information received from the image processing apparatus 1 to the server controller 93.

The server controller 93 is a CPU (Central Processing Unit) that collectively controls the management server 9. The server controller 93 performs order processing of ordering a consumable based on the information received through the server communication interface 91. This order processing includes determining whether to order a consumable. When ordering, the server controller 93 transmits information regarding the consumable order to an order server 7 through the server communication interface 91. This information includes, for example, information on and the number of consumables. Taking a case where the consumable is the ink cartridge 4 as an example, the information on the consumable is an ink ID, for example. Based on the information transmitted from the management server 9 to the order server 7, the consumable indicated by this information is shipped to the user.

The server memory 92 is a storage device that stores data necessary for the operation of the management server 9 and data necessary for the management of the image processing apparatus 1 and consumables. The server memory 92 stores printer information 921 and number of orders 922.

The printer information 921 is data including various information regarding the image processing apparatus 1. The printer information 921 is stored separately for each image processing apparatus 1. The printer information 921 includes at least a printer ID, contract information, and status data. In addition, the printer information 921 may include, for example, the model number of the image processing apparatus 1 and the date of manufacture.

The number of orders 922 is information in which the number of orders of the consumable used by the image processing apparatus 1 is stored for each image processing apparatus 1. As an example, the number of orders 922 is information in which the printer ID and the value indicating the number of orders are associated with each other. In the example where the consumable is the ink cartridge 4, the number of orders 922 is data for each type of the ink cartridge 4, that is, for each color. For example, in a case where the four-color ink cartridges 4 of cyan, magenta, yellow, and black are mounted on the image processing apparatus 1, the number of orders 922 corresponding to each of the four-color ink cartridges 4 is stored in the server memory 92 in association with the printer ID of the image processing apparatus 1.

<Flow of Various Processing>

Next, the flow of various processing executed by the controller 80 of the image processing apparatus 1 will be described with reference to FIGS. 3 to 6.

<Processing at the Time of Mounting>

Figure 3:
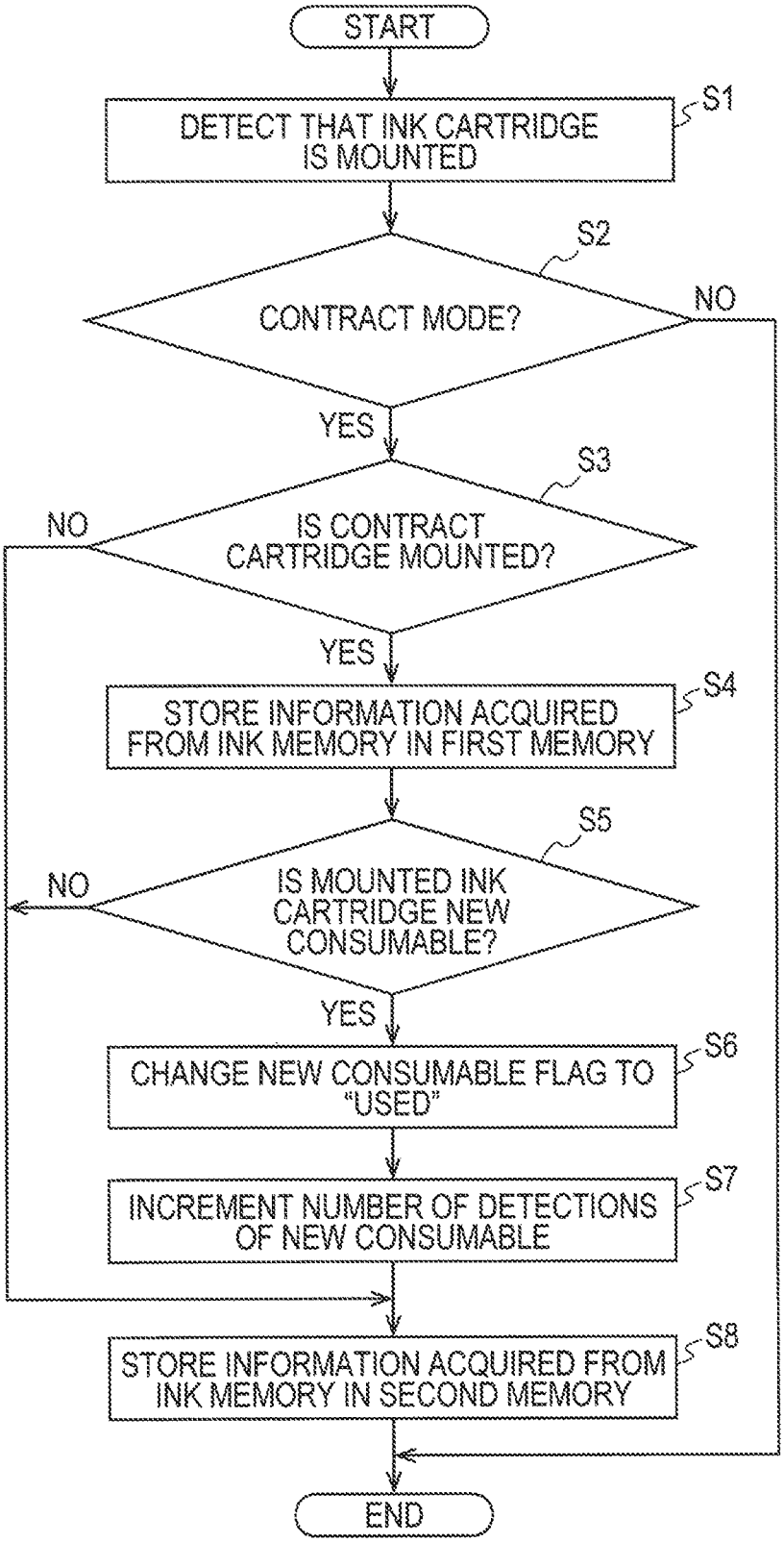
FIG. 3 is a flowchart showing an example of the flow of processing at the time of mounting, which is executed when an ink cartridge is mounted on the image processing apparatus.

In step S1 of FIG. 3, the controller 80 detects that the ink cartridge 4 is mounted. Hereinafter, step will be abbreviated as "S". For example, the controller 80 detects that the ink cartridge 4 is mounted, based on a signal from a sensor (not shown) provided at the mount portion (not shown) of the ink cartridge 4. The controller 80 acquires various information stored in the ink memory 42. Then, the processing at the time of mounting proceeds to S2.

In S2, the controller 80 refers to the contract information 833 stored in the second memory 83, and determines whether the image processing apparatus 1 is set to a contract mode. In response to determining that the contract mode is set (S2: YES), the processing at the time of mounting proceeds to S3. In response to determining that the contract mode is not set (S2: NO), the processing at the time of mounting ends.

In S3, the controller 80 refers to the acquired ink type information 422 and determines whether the mounted ink cartridge 4 is a contract cartridge. In response to determining that the cartridge is a contract cartridge (S3: YES), the processing at the time of mounting proceeds to S4. In response to determining that the cartridge is not a contract cartridge (S3: NO), the processing at the time of mounting proceeds to S8.

In S4, the controller 80 stores the information acquired from the ink memory 42, that is, the ink ID 421, the ink type information 422, and the ink remaining amount information 423 in the first memory 82 as the contract ink information 821. Then, the processing at the time of mounting proceeds to S5.

In S5, the controller 80 refers to the acquired new consumable flag 424 and determines whether the mounted ink cartridge 4 is a new consumable. In response to determining that the cartridge is a new consumable (S5: YES), the processing at the time of mounting proceeds to S6. In response to determining that the cartridge is not a new consumable (S5: NO), the processing at the time of mounting proceeds to S8.

In S6, the controller 80 updates the new consumable flag 424 stored in the ink memory 42 with information indicating an old consumable, that is, a used consumable.

In S7 (number of mounting update step), the controller 80 increments the number of detections of new consumable 822 stored in the first memory 82. In a case where the number of detections of new consumable 822 is data for each color, the controller 80 identifies and increments the number of detections of new consumable to be updated, based on the information acquired from the ink memory 42. After that, the processing at the time of mounting ends.

In S8, the controller 80 stores the information acquired from the ink memory 42, that is, the ink ID 421, the ink type information 422, and the ink remaining amount information 423 in the second memory 83 as the used ink information 831. After that, the processing at the time of mounting ends.

As described above, when the ink cartridge 4 is mounted, the controller 80 increments the number of detections of new consumable 822 corresponding to the ink cartridge 4 if all of the following conditions are satisfied, (1) the contract mode is set, (2) a contract cartridge is mounted, and (3) a new consumable is mounted. The controller 80 stores the ink ID 421, the ink type information 422, and the ink remaining amount information 423 in the first memory 82 only when the contract cartridge is mounted. In other words, when a commercial cartridge is mounted, the controller 80 does not store the ink ID 421, the ink type information 422, and the ink remaining amount information 423 in the first memory 82.

<Ink Information Update Processing>

Figure 4:
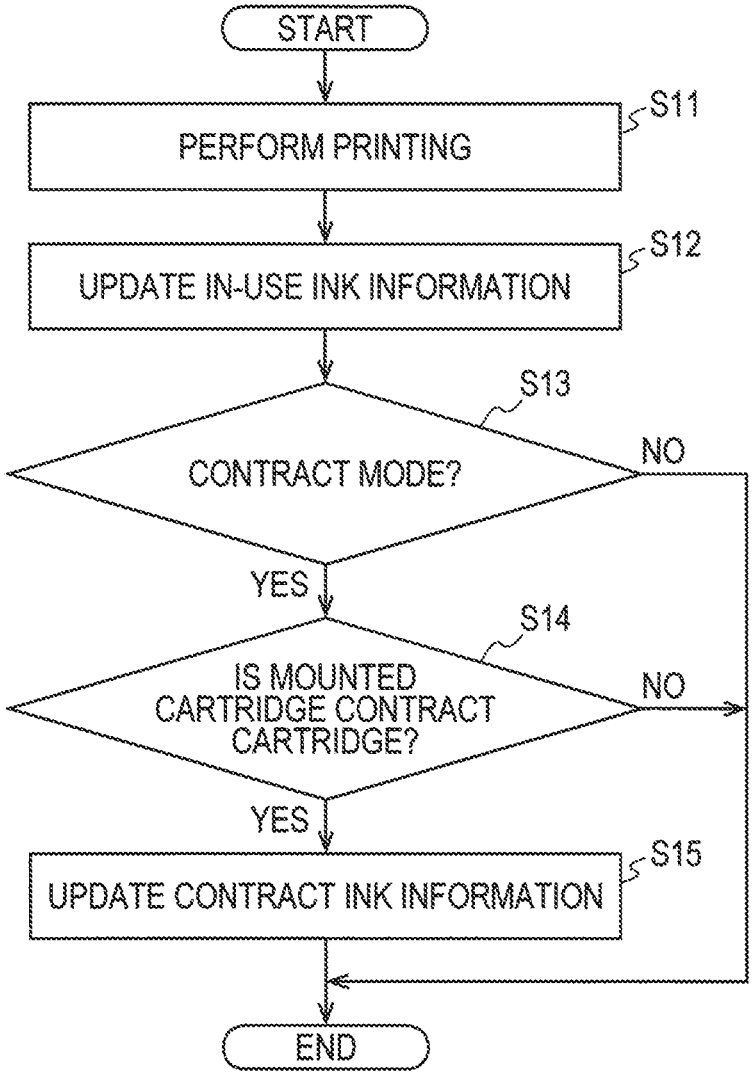
FIG. 4 is a flowchart showing an example of the flow of ink information update processing by the image processing apparatus.

In S11 of FIG. 4, the controller 80 causes the image processing device 84 to execute printing based on the signal for executing a print job input through an input interface and so on. Then, the ink information update processing proceeds to S12.

In S12, the controller 80 updates the used ink information 831 stored in the second memory 83. Specifically, the controller 80 updates the ink remaining amount information of the used ink information 831 based on the amount of ink used for printing. Then, the ink information update processing proceeds to S13.

In S13, the controller 80 refers to the contract information 833 stored in the second memory 83, and determines whether the image processing apparatus 1 is set to the contract mode. In response to determining that the contract mode is set (S13: YES), the ink information update processing proceeds to S14. In response to determining that the contract mode is not set (S13: NO), the ink information update processing ends.

In S14, the controller 80 refers to the used ink information 831 stored in the second memory, and determines whether the ink cartridge 4 mounted on the image processing apparatus 1 is a contract cartridge. In response to determining that the cartridge is a contract cartridge (S14: YES), the ink information update processing proceeds to S15. In response to determining that the cartridge is not a contract cartridge (S14: NO), the ink information update processing ends.

In S15 (life update step), the controller 80 updates the contract ink information 821 stored in the first memory 82. Specifically, the controller 80 updates the ink remaining amount information of the contract ink information 821 based on the amount of ink used for printing. After that, the ink information update processing ends.

As described above, when printing is performed using the contract cartridge in the contract mode, the controller 80 updates the ink remaining amount information for both the contract ink information 821 and the used ink information 831. When printing is performed using a commercial cartridge in the contract mode, the controller 80 updates only the ink information of the used ink information 831 among the contract ink information 821 and the used ink information 831.

<Notification Processing>

Figure 5:
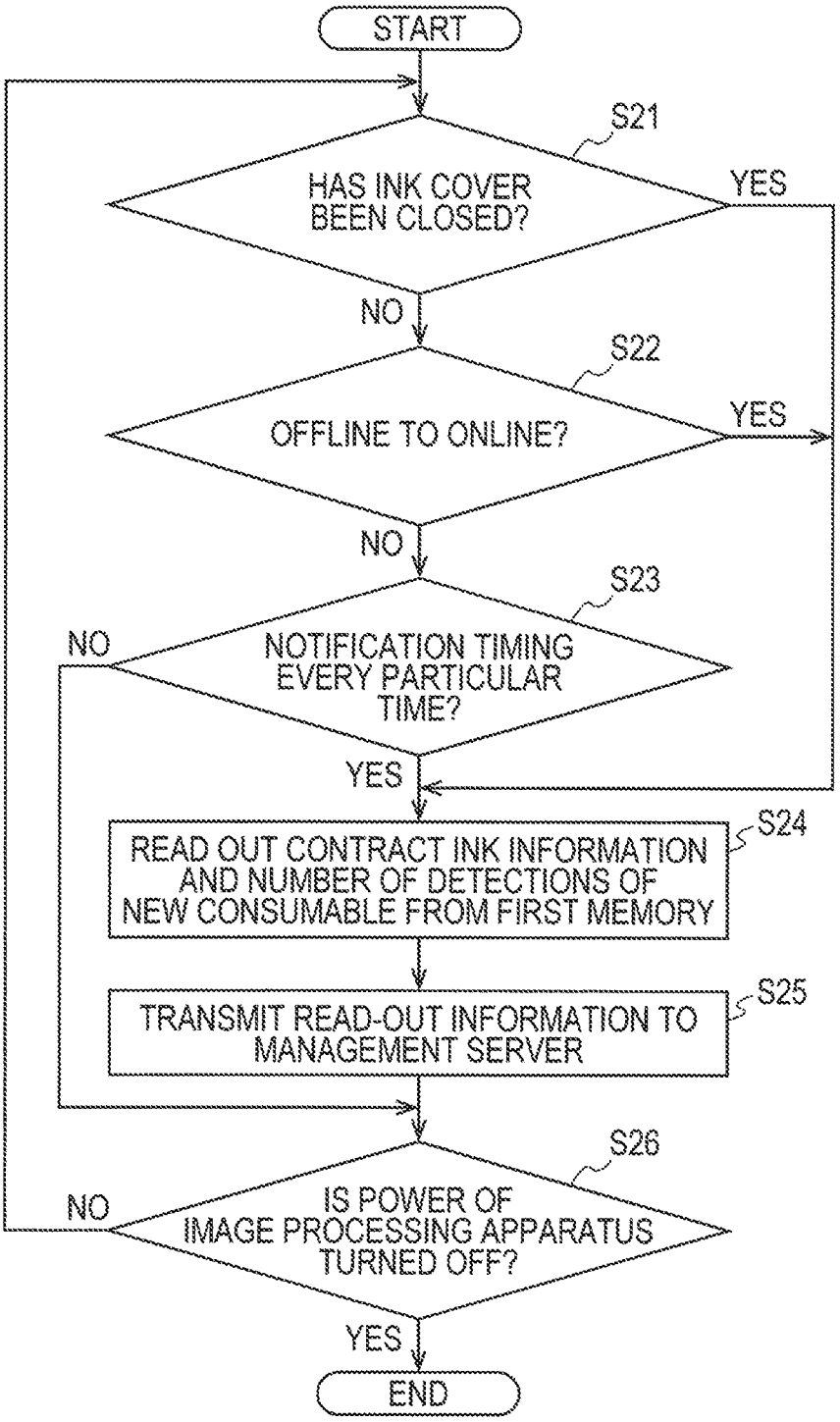
FIG. 5 is a flowchart showing an example of the flow of notification processing by the image processing apparatus.
Figure 6:
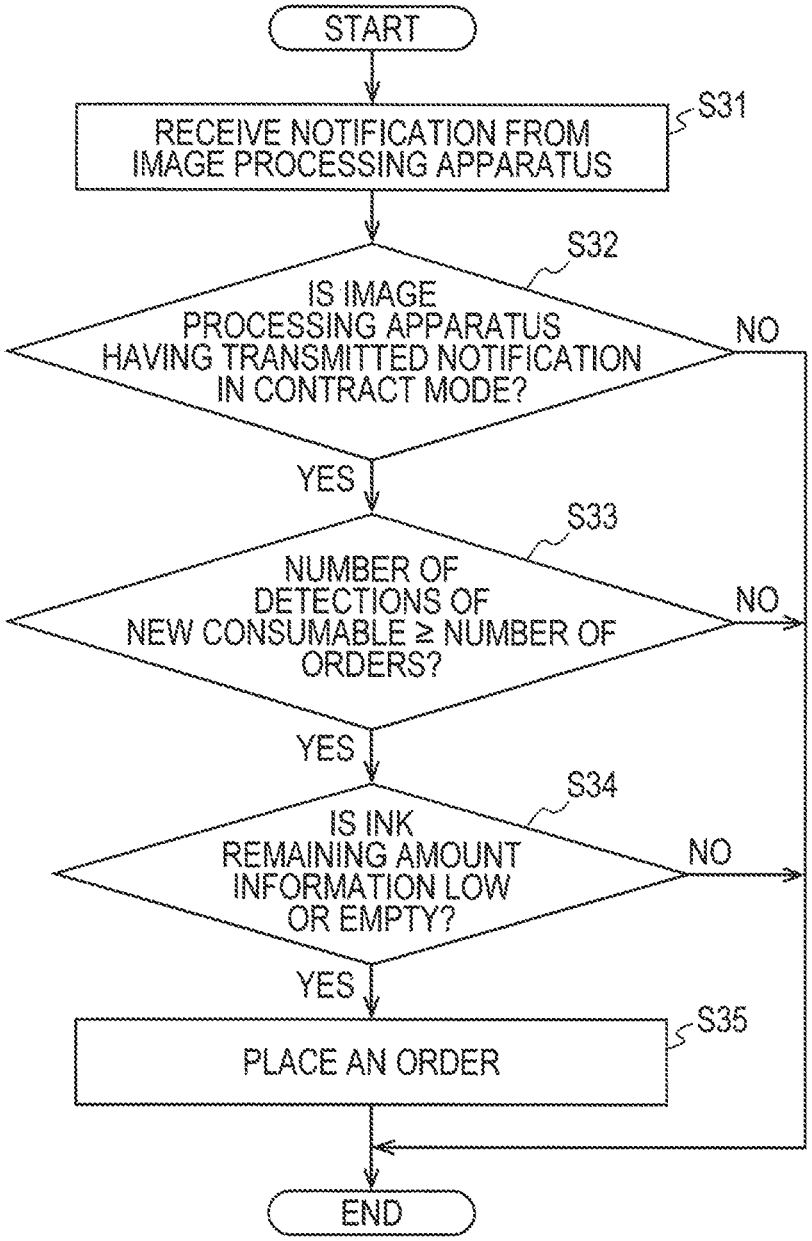
FIG. 6 is a flowchart showing an example of the flow of order processing by a management server according to a first embodiment.

In S21 of FIG. 5, the controller 80 detects whether the ink cover is closed (S21). The ink cover is a cover provided at the mount portion (not shown) on which the ink cartridge 4 is mounted. When the user mounts the ink cartridge 4 on the image processing apparatus 1, the user opens the ink cover to mount the ink cartridge 4 and closes the ink cover. In response to detecting that the ink cover is closed (S21: YES), the notification processing proceeds to S24. In response to not detecting that the ink cover is closed (S21: NO), the notification processing proceeds to S22.

In S22, the controller 80 detects whether the image processing apparatus 1 has changed from an offline state to an online state. The offline state refers to a state in which the image processing apparatus 1 is unable to communicate with the management server 9 and so on through the communication interface 81. The online state refers to a state in which the image processing apparatus 1 is able to communicate with the management server 9 and so on through the communication interface 81. In response to detecting that the state has changed from the offline state to the online state (S22: YES), the notification processing proceeds to S24. In response to not detecting that the state has changed from the offline state to the online state (S22: NO), the notification processing proceeds to S23.

In S23, the controller 80 determines whether the notification timing at each particular time has come. The particular time is, for example, twelve hours, but is not limited thereto. In response to determining that the notification timing has come (S23: YES), the notification processing proceeds to S24. In response to determining that the notification timing has not come (S23: NO), the notification processing proceeds to S26.

In S24, the controller 80 reads out the contract ink information 821 and the number of detections of new consumable 822 from the first memory 82. Then, the notification processing proceeds to S25.

In S25 (transmission step), the controller 80 transmits the read contract ink information 821 and number of detections of new consumable 822 to the management server 9 through the communication interface 81. Then, the notification processing proceeds to S26.

In S26, the controller 80 waits for the image processing apparatus 1 to be powered off. Specifically, the controller 80 waits for the acquisition of the power OFF signal based on the operation input to the input interface (not shown) of the image processing apparatus 1. When the power OFF signal is acquired (S26: YES), the notification processing ends. If the power OFF signal has not been acquired (S26: NO), the notification processing returns to S21.

As described above, the controller 80 transmits the contract ink information 821 and the number of detections of new consumable 822 to the management server 9 when any one of the following is satisfied; (1) the ink cover is closed, (2) the image processing apparatus 1 has changed from the offline state to the online state, and (3) the particular notification timing has come.

<Order Determination Processing>

The order determination processing of the first embodiment will be described. In S31 of FIG. 6, the server controller 93 receives a notification from the image processing apparatus 1 through the server communication interface 91. Then, the order processing proceeds to S32.

In S32, the server controller 93 determines whether the image processing apparatus 1 of the notification source is in the contract mode. As an example, the server controller 93 refers to the printer information 921 stored in the server memory 92, and determines whether the image processing apparatus 1 of the notification source is in the contract mode. In response to determining that the image processing apparatus 1 is in the contract mode (S32: YES), the order processing proceeds to S33. In response to determining that the image processing apparatus 1 is not in the contract mode (S32: NO), the order processing ends.

In S33, the server controller 93 compares the transmitted number of detections of new consumable 822 and the number of orders 922 to determine whether the condition that the value indicated by the number of detections of new consumable is larger than or equal to the value indicated by the number of orders (the number of detections of new consumable≥the number of orders) is satisfied. In response to determining that the condition is satisfied (S33: YES), the order processing proceeds to S34. If the condition is not satisfied, that is, if the value indicated by the number of detections of new consumable is smaller than the value indicated by the number of orders, the order processing ends.

In S34, the server controller 93 refers to the transmitted ink remaining amount information and determines whether the ink remaining amount information is "Low" or "Empty". If the ink remaining amount information is "Low" or "Empty" (S33: YES), the order processing proceeds to S35. If the ink remaining amount information is not "Low" or "Empty", that is, "Full" which is the initial value, the order processing ends.

In S35 (order processing), the server controller 93 places an order to the order server 7. Specifically, the server controller 93 transmits information on a contract cartridge having an ink remaining amount of "Low" or "Empty" to the order server 7 so that a contract cartridge is shipped to a user.

When S35 is executed, the server controller 93 increments the value indicating the number of orders in the record corresponding to the image processing apparatus 1 of the notification source in the number of orders 922 (number-of-order update step). In this way, the order processing ends.

As described above, when the number of detections of new consumable is smaller than the number of orders, the server controller 93 does not place an order regardless of the ink remaining amount information.

<Suppression of Multiple Order>

With reference to FIGS. 7 and 8, the suppression of multiple order by the order management system 100 according to the first embodiment will be described. Multiple order means that the user possesses more consumables than an appropriate amount by ordering more consumables than an appropriate amount.

<Order Management of Comparative Example>

In the order management in the order management system of a comparative example of FIG. 7, the management server 9 determines whether an order is to be placed based on only the ink remaining amount information of the contract cartridge used in the image processing apparatus 1. In the order management of the comparative example, the notification from the image processing apparatus 1 to the management server 9 is sent when the image processing apparatus 1 has changed from an offline state to an online state, or when a particular notification timing has come. In other words, in the order management in the order management system of the comparative example, the notification is not sent when the ink cover is closed.

In FIG. 7, the "user" column shows the processing executed by the user or the image processing apparatus 1. The "notification" column shows whether the notification is sent from the image processing apparatus 1 to the management server 9. The "ink remaining amount information" column shows the transmitted ink remaining amount information. The "number of orders" column shows the number of orders 922 at the time the notification is received. Since FIG. 7 shows order management in the order management system of the comparative example, the number of detections of new consumable is not used. The definition of the information shown in each column is the same in the examples shown in the following tables.

In the examples shown in FIGS. 7 to 10, it is assumed that the user has one image processing apparatus 1.

In P1, the user registers the image processing apparatus 1 for a service, that is, makes a contract for the service. As a result, information regarding service registration is transmitted to the management server 9, and the management server 9 manages the image processing apparatus 1 assuming that the image processing apparatus 1 is in the contract mode. The management server 9 transmits information regarding the order of a starter kit to the order server 7 so that the starter kit is shipped to the user. The starter kit includes a contract cartridge for each of the ink cartridges 4 used by the image processing apparatus 1. As an example, when the ink cartridges 4 used by the image processing apparatus 1 are magenta, cyan, yellow, and black ink cartridges, the starter kit includes the contract cartridges of these four colors.

In FIG. 7 and thereafter, in order to facilitate understanding, it is assumed that the ink cartridge 4 used by the image processing apparatus 1 is one color (for example, only black).

In P2, the user mounts a contract cartridge 4A of the shipped starter kit on the image processing apparatus 1.

In P3, the user performs printing in the image processing apparatus 1.

As a result, the ink remaining amount information stored in the image processing apparatus 1 is updated.

In P4, since the particular notification timing has come, the image processing apparatus 1 transmits the ink remaining amount information to the management server 9. In P4, since the ink remaining amount information is "Full" (80 percent), no order is placed.

In P5, the user performs printing in the image processing apparatus 1. As a result, the ink remaining amount information stored in the image processing apparatus 1 is updated.

In P6, since the particular notification timing has come, the image processing apparatus 1 transmits the ink remaining amount information to the management server 9. In P6, since the ink remaining amount information is "Low" (40 percent), the management server 9 orders a contract cartridge. Hereinafter, the contract cartridge ordered in P6 will be referred to as a contract cartridge 4B.

In P7, it is assumed that the user does not mount the contract cartridge 4B on the image processing apparatus 1, but mounts the contract cartridge 4A whose ink remaining amount information is "Low" in the image processing apparatus 1 again. After that, the user does not perform printing in the image processing apparatus 1.

In P8, since the particular notification timing has come, the image processing apparatus 1 transmits the ink remaining amount information to the management server 9. In P8, since the ink remaining amount information is "Low" (40 percent), the management server 9 orders a contract cartridge 4C.

In P9, the user mounts the contract cartridge 4A on the image processing apparatus 1 again instead of the contract cartridge 4B or the contract cartridge 4C. After that, the user does not perform printing in the image processing apparatus 1.

In P10, since the particular notification timing has come, the image processing apparatus 1 transmits the ink remaining amount information to the management server 9. In P10, since the ink remaining amount information is "Low" (40 percent), the management server 9 orders a contract cartridge 4D.

In P11, the user mounts the contract cartridge 4A to the image processing apparatus 1 again instead of the contract cartridge 4B, the contract cartridge 4C, or the contract cartridge 4D.

As described above, when the ink remaining amount information of the contract cartridge 4A becomes "Low" and a new contract cartridge 4 is ordered, there may be a case where the contract cartridge 4A is mounted on the image processing apparatus 1 again without mounting the ordered contract cartridge 4 on the image processing apparatus. By repeating such an operation, the new contract cartridges 4C and 4D are ordered in addition to the necessary contract cartridge 4B. In this way, in the order management system of the comparative example, multiple order may occur.

<Order Management According to First Embodiment>

In FIG. 8, a "number of detections of new consumable" column is added to FIG. 7. The "number of detections of new consumable" column shows the number of detections of new consumable 822 at that time.

In P21 of FIG. 8, the user registers the image processing apparatus 1 for a service, that is, makes a contract for the service. As a result, information regarding service registration is transmitted to the management server 9, and the management server 9 manages the image processing apparatus 1 assuming that the image processing apparatus 1 is in the contract mode. The management server 9 transmits information regarding the order of a starter kit to the order server 7 so that the starter kit is shipped to the user. As a result, the number of orders 922 becomes "1".

In P22, the user mounts a contract cartridge 4A of the shipped starter kit on the image processing apparatus 1. As a result, the image processing apparatus 1 increments the number of detections of new consumable 822, and the number of detections of new consumable 822 becomes "1". The image processing apparatus 1 transmits the contract ink information 821 and the number of detections of new consumable 822 to the management server 9. In P22, although the condition that "number of detections of new consumable" is larger than or equal to "number of orders" is satisfied ("number of detections of new consumable"≥"number of orders"), since the ink remaining amount information is "Full" (100 percent), no order is placed.

In P23, the user performs printing in the image processing apparatus 1. As a result, the ink remaining amount information stored in the image processing apparatus 1 is updated.

In P24, since the particular notification timing has come, the image processing apparatus 1 transmits the contract ink information 821 and the number of detections of new consumable 822 to the management server 9. In P24, although the condition that "number of detections of new consumable" is larger than or equal to "number of orders" is satisfied, since the ink remaining amount information is "Full" (80 percent), no order is placed.

In P25, the user performs printing in the image processing apparatus 1. As a result, the ink remaining amount information stored in the image processing apparatus 1 is updated.

In P26, since the particular notification timing has come, the image processing apparatus 1 transmits the contract ink information 821 and the number of detections of new consumable 822 to the management server 9. In P26, since the condition that "number of detections of new consumable" is larger than or equal to "number of orders" is satisfied, and the ink remaining amount information is "Low" (40 percent), the management server 9 orders a contract cartridge. As a result, the number of orders 922 becomes "2". Hereinafter, the contract cartridge ordered in P26 is referred to as a contract cartridge 4B.

In P27, the user mounts the contract cartridge 4B on the image processing apparatus 1. As a result, the image processing apparatus 1 increments the number of detections of new consumable 822, and the number of detections of new consumable 822 becomes "2". The image processing apparatus 1 transmits the contract ink information 821 and the number of detections of new consumable 822 to the management server 9. In P27, although the condition that "number of detections of new consumable" is larger than or equal to "number of orders" is satisfied, since the ink remaining amount information is "Full" (100 percent), no order is placed.

In P28, it is assumed that the user mounts the contract cartridge 4A whose ink remaining amount information is "Low" on the image processing apparatus 1 again instead of the contract cartridge 4B. The image processing apparatus 1 transmits the contract ink information 821 and the number of detections of new consumable 822 to the management server 9. In the state of P28, since the condition that "number of detections of new consumable" is larger than or equal to "number of orders" is satisfied, and the ink remaining amount information is "Low" (40 percent), the management server 9 orders a contract cartridge. As a result, the number of orders 922 becomes "3". The contract cartridge ordered in P28 is referred to as a contract cartridge 4C.

In P29, it is assumed that the user does not mount the contract cartridge 4C newly ordered in place of the contract cartridge 4A on the image processing apparatus 1, but mounts the contract cartridge 4B on the image processing apparatus 1 again. The image processing apparatus 1 transmits the contract ink information 821 and the number of detections of new consumable 822 to the management server 9. In P29, since the condition that "number of detections of new consumable" is larger than or equal to "number of orders" is not satisfied, no order is placed.

In P30, it is assumed that the user mounts the contract cartridge 4A on the image processing apparatus 1 again in place of the contract cartridge 4B. The image processing apparatus 1 transmits the contract ink information 821 and the number of detections of new consumable 822 to the management server 9. In P30, although the ink remaining amount information is "Low", since the condition that "number of detections of new consumable" is larger than or equal to "number of orders" is not satisfied, no order is placed.

As described above, the order management system 100 according to the first embodiment does not order a contract cartridge when the number of detections of new consumable is smaller than the number of orders. As a result, multiple order does not occur even if the user uses an old contract cartridge without using a new contract cartridge, that is, in a situation where multiple order can occur.

The order management system 100 according to a modification of the first embodiment may order a contract cartridge when the number of detections of new consumable is smaller than or equal to the number of orders and the ink remaining amount information is "Low" or "Empty". The order management system 100 may be configured not to order a contract cartridge when the number of detections of new consumable of the contract cartridge exceeds the number of orders and the ink remaining amount information is "Low" or "Empty". As a result, multiple order does not occur even if the user uses a contract cartridge of another image processing apparatus 1 without using the contract cartridge of a certain image processing apparatus 1, that is, in a situation where multiple order can occur.

In this modification, a contract cartridge is ordered when the number of detections of new consumable is smaller than or equal to number of orders and the ink remaining amount information is "Low" or "Empty". Thus, an order will be placed if the condition that "number of detections of new consumable" is smaller than "number of orders" is satisfied in P30. In contrast, in the order management system 100 according to this embodiment, no order is placed unless the condition that "number of detections of new consumable" is larger than or equal to "number of orders" is satisfied as in P30. Thus, further multiple order is suppressed.

<Suppression of Order Omission>

With reference to FIGS. 9 and 10, the suppression of order omission by the order management system 100 according to the first embodiment will be described. Order omission refers to a situation in which an order is not placed in a situation where an order should be placed and the user does not have a usable contract cartridge.

<Order Processing of Comparative Example>

In the order management of a comparative example of FIG. 9, the image processing apparatus 1 transmits the used ink information 831 to the management server 9, and the management server 9 places an order when the transmitted used ink information 831 is the used ink information 831 of the contract cartridge and the ink remaining amount is low. In the order management, the notification is sent from the image processing apparatus 1 to the management server 9 when the image processing apparatus 1 has changed from an offline state to an online state, or when a particular notification timing has come. In other words, in the order management of the comparative example, the notification is not sent when the ink cover is closed.

In P41, the user registers the image processing apparatus 1 for a service, that is, makes a contract for the service. As a result, information regarding service registration is transmitted to the management server 9, and the management server 9 manages the image processing apparatus 1 assuming that the image processing apparatus 1 is in the contract mode. The management server 9 transmits information regarding the order of a starter kit to the order server 7 so that the starter kit is shipped to the user.

In P42, the user mounts a contract cartridge of the shipped starter kit on the image processing apparatus 1.

In P43, the user performs printing in the image processing apparatus 1. As a result, the ink remaining amount information stored in the image processing apparatus 1 is updated.

In P44, since the particular notification timing has come, the image processing apparatus 1 transmits the ink remaining amount information to the management server 9. In P44, since the ink remaining amount information is "Full", no order is placed.

In P45, the user performs printing in the image processing apparatus 1. As a result, the ink remaining amount information stored in the image processing apparatus 1 is updated.

In P46, it is assumed that the contract ink cartridge mounted on the image processing apparatus 1 has run out of ink. In P46, the user does not have a new contract cartridge because the ink has run out before the notification timing. In P47, the user mounts a commercial cartridge on the image processing apparatus 1.

In P48, the user performs printing in the image processing apparatus 1. As a result, the ink remaining amount information stored in the image processing apparatus 1 is updated. This ink remaining amount information is the ink remaining amount information of the commercial cartridge mounted in P47.

In P49, since the particular notification timing has come, the image processing apparatus 1 transmits the ink remaining amount information to the management server 9. In P49, although the ink remaining amount information is "Low", the management server 9 does not place an order based on the ink remaining amount information of the commercial cartridge. Thus, in P49, a contract cartridge is not ordered. That is, a new contract cartridge is not ordered although the contract cartridge is "Empty" in the image processing apparatus 1. In this way, order omission may occur in the order management system of the comparative example.

<Order Management According to First Embodiment>

In FIG. 10, a "number of detections of new consumable" column is added to FIG. 9.

In P51, the user registers the image processing apparatus 1 for a service, that is, makes a contract for the service. As a result, information regarding service registration is transmitted to the management server 9, and the management server 9 manages the image processing apparatus 1 assuming that the image processing apparatus 1 is in the contract mode. The management server 9 transmits information regarding the order of a starter kit to the order server 7 so that the starter kit is shipped to the user.

In P52, the user mounts the contract cartridge of the shipped starter kit on the image processing apparatus 1. As a result, the image processing apparatus 1 increments the number of detections of new consumable 822, and the number of detections of new consumable 822 becomes "1". The image processing apparatus 1 transmits the contract ink information 821 and the number of detections of new consumable 822 to the management server 9. In P52, although the condition that "number of detections of new consumable" is larger than or equal to "number of orders" is satisfied, since the ink remaining amount information is "Full", no order is placed.

In P53, the user performs printing in the image processing apparatus 1. As a result, the ink remaining amount information stored in the image processing apparatus 1 is updated.

In P54, since the particular notification timing has come, the image processing apparatus 1 transmits the contract ink information 821 and the number of detections of new consumable 822 to the management server 9. In P54, although the condition that "number of detections of new consumable" is larger than or equal to "number of orders" is satisfied, since the ink remaining amount information is "Full" (80 percent), no order is placed.

In P55, the user performs printing in the image processing apparatus 1. As a result, the ink remaining amount information stored in the image processing apparatus 1 is updated.

In P56, it is assumed that the contract ink cartridge mounted on the image processing apparatus 1 has run out of ink. In P56, the user does not have a new contract cartridge because the ink has run out before the notification timing.

In P57, the user mounts a commercial cartridge on the image processing apparatus 1. As a result, although the used ink information 831 is updated with the information of the commercial cartridge, the contract ink information 821 retains the information of the contract cartridge that has run out of ink in P56. The image processing apparatus 1 transmits the contract ink information 821 and the number of detections of new consumable 822 to the management server 9. In P56, since the condition that "number of detections of new consumable" is larger than or equal to "number of orders" is satisfied, and the ink remaining amount information is "Empty", the management server 9 orders a contract cartridge.

As described above, the order management system 100 according to the first embodiment transmits the contract ink information 821 at the time of notification regardless of the type of the ink cartridge 4 mounted on the image processing apparatus 1. As a result, order omission does not occur even in a situation where order omission can occur in the order management system of the comparative example.

<Operations and Effects>

As described above, the order management system 100 according to the first embodiment includes the image processing apparatus 1 and the management server 9.

The image processing apparatus 1 includes the image processing device 84 that performs printing using the ink cartridge 4 mounted in the apparatus itself. The image processing apparatus 1 includes the communication interface 81 for connecting to a network. The image processing apparatus 1 includes the first memory 82 that stores the number of detections of new consumable 822, which is the number of times a new contract cartridge is mounted, and the first memory 82 that stores the ink remaining amount information of the mounted contract cartridge. The image processing apparatus 1 includes the controller 80. When a new contract cartridge is mounted, the controller 80 executes number-of-mounting update processing of incrementing the number of detections of new consumable 822. The controller 80 executes a life update processing of updating the ink remaining amount information in response to execution of the image processing. The controller 80 executes transmission processing of transmitting the number of detections of new consumable 822 and the ink remaining amount information to the management server 9 through the communication interface 81 at a particular timing.

The management server 9 includes the server communication interface 91 for connecting to a network. The management server 9 includes the server memory 92 that stores the number of orders 922 of the contract cartridge. The management server 9 includes the server controller 93. When the server controller 93 receives the number of detections of new consumable 822 and the ink remaining amount information through the server communication interface 91, a contract cartridge is not ordered if a magnitude relationship between the number of detections of new consumable 822 and the number of orders 922 satisfies a first condition, or the ink remaining amount information is "Full." In contrast, a contract cartridge of the ink cartridge 4 is ordered if the magnitude relationship between the number of detections of new consumable 822 and the number of orders 922 satisfies a second condition different from the first condition, and the ink remaining amount information is "Low" or "Empty." When an order is placed in the order processing, the server controller 93 executes number-of-order update processing of incrementing the number of orders 922.

When a normal usage state of the contract cartridge, in which an ordered contract cartridge is used until the ink remaining amount information becomes "Low" or "Empty" after being mounted on the image processing apparatus 1, is repeated, the contract cartridge is properly ordered. In this case, the second condition is satisfied from the magnitude relationship between the number of detections of new consumable 822 and the number of orders 922. However, in an unusual usage state of the contract cartridge, even if the ink remaining amount of the contract cartridge becomes "Low" or "Empty", the second condition is not satisfied due to the magnitude relationship between the number of detections of new consumable 822 and the number of orders 922, but the first condition is satisfied. Examples of the above-mentioned usage state include a case where a contract cartridge having an ink remaining amount of "Low" or "Empty" is mounted on the image processing apparatus 1 after ordering. Examples of the above-mentioned usage state include a case where a new contract cartridge ordered for another image processing apparatus, different from a new contract cartridge that should be mounted, is mounted on the image processing apparatus 1. In such a case, since a new order is not placed after that, ordering mistake of contract cartridges, specifically, multiple order for contract cartridges is suppressed.

The first condition is that the number of detections of new consumable 822 is smaller than the number of orders 922, and the second condition is that the number of detections of new consumable 822 is larger than or equal to the number of orders 922.

A situation in which the number of orders 922 is larger than the number of detections of new consumable 822 occurs when a new contract cartridge ordered for the image processing apparatus 1 and an old contract cartridge whose ink remaining amount is "Low" or "Empty" are alternately mounted on the image processing apparatus 1. Specifically, when a user mounts an ordered new contract cartridge on the image processing apparatus 1, the number of detections of new consumable 822 is incremented, and then an old contract cartridge is mounted on the image processing apparatus 1. As a result, the server is notified that the ink remaining amount of the new contract cartridge has become "Low" or "Empty". As a result, the user obtains an additional new contract cartridge although the ink remaining amount of the new contract cartridge has not become "Low" or "Empty".

According to the above-described embodiment, even if an old contract cartridge is mounted on the image processing apparatus 1 after an ordered new contract cartridge is mounted on the image processing apparatus 1, subsequent orders for contract cartridges will not be placed when the first condition is satisfied. As a result, ordering mistake of contract cartridges, specifically, multiple order for contract cartridges is suppressed.

Alternatively, the first condition may be that the number of detections of new consumable 822 is different from the number of orders 922, and the second condition may be that the number of detections of new consumable 822 is equal to the number of orders 922.

A situation where the number of detections of new consumable 822 is different from the number of orders 922 occurs in a usage state different from a normal contract cartridge usage state in which a new contract cartridge is used until the ink remaining amount becomes "Low" or "Empty" after being mounted on the image processing apparatus 1. According to the above configuration, a contract cartridge is not ordered if the first condition is satisfied by the above different usage state, whereas a contract cartridge is ordered if the second condition is satisfied by the above normal usage state. As a result, ordering mistake of contract cartridges, specifically, multiple order for contract cartridges is suppressed.

The particular timing in the transmission processing includes the time point when the ink cover is closed. According to this configuration, the transmission processing is performed when the ink cover is closed, that is, at the timing when it is highly likely that a new contract cartridge is mounted on the image processing apparatus 1. Thus, an increase in the number of detections of new consumable 822 and the ink remaining amount information due to the mounting of a new contract cartridge is transmitted to the management server 9 in real time.

The image processing apparatus 1 in the contract mode is usable by mounting a commercial cartridge in addition to the contract cartridge. The server controller 93 does not order a contract cartridge based on the ink remaining amount information of the commercial cartridge, but orders a contract cartridge based on the ink remaining amount information of the contract cartridge. In the transmission processing, the controller 80 transmits only the ink remaining amount information of the contract cartridge among the ink remaining amount information of the contract cartridge and the ink remaining amount information of the commercial cartridge.

According to the above configuration, the management server 9 does not order a contract cartridge based on the ink remaining amount information of the commercial cartridge, but orders a contract cartridge based on the ink remaining amount information of the contract cartridge. Since the image processing apparatus 1 transmits only the ink remaining amount information of the contract cartridge among the ink remaining amount information of the contract cartridge and the ink remaining amount information of the commercial cartridge, the contract cartridge is reliably ordered. As a result, order omission of contract cartridges is suppressed.

In the life update processing, when the ink cartridge 4 currently mounted on the image processing apparatus 1 is a contract cartridge, the controller 80 updates both the ink remaining amount information of the contract ink information 821 stored in the first memory 82 and the ink remaining amount information of the used ink information 831 stored in the second memory 83. In the life update processing, when the ink cartridge 4 currently mounted on the image processing apparatus 1 is a commercial cartridge, the controller 80 updates the ink remaining amount information of the used ink information 831 stored in the second memory 83 among the two ink remaining amount information. In the transmission processing, the controller 80 transmits the contract ink information 821 among the contract ink information 821 and the used ink information 831.

It is assumed that the ink cartridge 4 of the image processing apparatus 1 is replaced with a commercial cartridge from a contract cartridge whose remaining amount is "Low" or "Empty". In the comparative example, when the timing of the transmission processing comes after this replacement, the ink remaining amount information of the ink cartridge 4 currently in use, that is, the commercial cartridge is transmitted. However, a contract cartridge is not ordered even if the remaining amount indicated by the ink remaining amount information is "Low" or "Empty". Since the server is not notified that the remaining amount of the contract cartridge has become "Low" or "Empty", so-called order omission occurs.

In contrast, according to the above configuration, when a commercial cartridge is mounted, the ink remaining amount information of the contract ink information 821 is not updated, and the contract ink information 821 is transmitted in the transmission processing. As a result, the information of the contract cartridge whose remaining amount is "Low" or "Empty" is transmitted to the management server 9 without omission. As a result, ordering mistake of contract cartridges, specifically, order omission of contract cartridges is suppressed.

The controller 80 further executes determination processing of determining whether a contract cartridge is mounted. In the number of mounting update processing, in response to determining in the determination processing that a new ink cartridge 4 is mounted on the image processing apparatus 1 and the contract cartridge is mounted, the controller 80 increments the number of detections of new consumable 822. The controller 80 does not increment the number of detections of new consumable 822 in response to determining in the determination processing that the contract cartridge is not mounted.

According to the above configuration, since the number of detections of new consumable 822 is incremented only when a new contract cartridge is mounted, the accurate number of times the contract cartridge is mounted is transmitted to the management server 9. As a result, the management server 9 accurately determines whether it is necessary to order a contract cartridge.

If the image processing is executed many times in a short period of time, the mounted contract cartridge may become unusable before the particular timing for performing the transmission processing. In this case, it can be considered that the user of the image processing apparatus 1 may have to use a commercial cartridge. In such a case, if the number of detections of new consumable 822 is incremented without distinguishing between the contract cartridge and the commercial cartridge, the transmission processing is executed in a state where the number of detections of new consumable 822 is larger than the number of orders 922. Thus, depending on the first condition and the second condition described above, the contract cartridge may or may not be ordered. In contrast, according to the above configuration, since the number of detections of new consumable 822 is incremented only when a new contract cartridge is mounted, it follows the normal usage state of contract cartridges. Thus, as described above, a normal order is placed when the user uses a commercial cartridge without malicious intent.

The controller 80 further performs second determination processing to determine whether the image processing apparatus 1 is in the contract mode. In the number-of-mounting update processing, when a new contract cartridge is mounted on the image processing apparatus 1 and it is determined in the second determination processing that the image processing apparatus 1 is in the contract mode, the controller 80 increments the number of detections of new consumable 822. In response to determining in the second determination processing that the image processing apparatus 1 is not in the contract mode, the controller 80 does not increment the number of detections of new consumable 822.

Consider a case where a contract cartridge of another image processing apparatus 1 in the contract mode is mistakenly mounted on the image processing apparatus 1 in the normal mode. If the number of detections of new consumable 822 is incremented at this time, when the user notices an error and removes the contract cartridge and then the image processing apparatus 1 is set to the contract mode, the number of detections of new consumable 822 is incremented again by mounting the contract cartridge. As a result, the number of detections of new consumable 822 is larger than the number of orders 922, and depending on the above-mentioned first condition and second condition, subsequent orders may or may not be placed. On the other hand, according to the above configuration, the number of detections of new consumable 822 is not incremented when a new contract cartridge is mounted on the image processing apparatus 1 in the normal mode. Thus, in a case where the user notices an error and removes the contract cartridge and then the image processing apparatus 1 is set to the contract mode, the contract cartridge is ordered as usual.

<Order Determination Processing>

Figure 11:
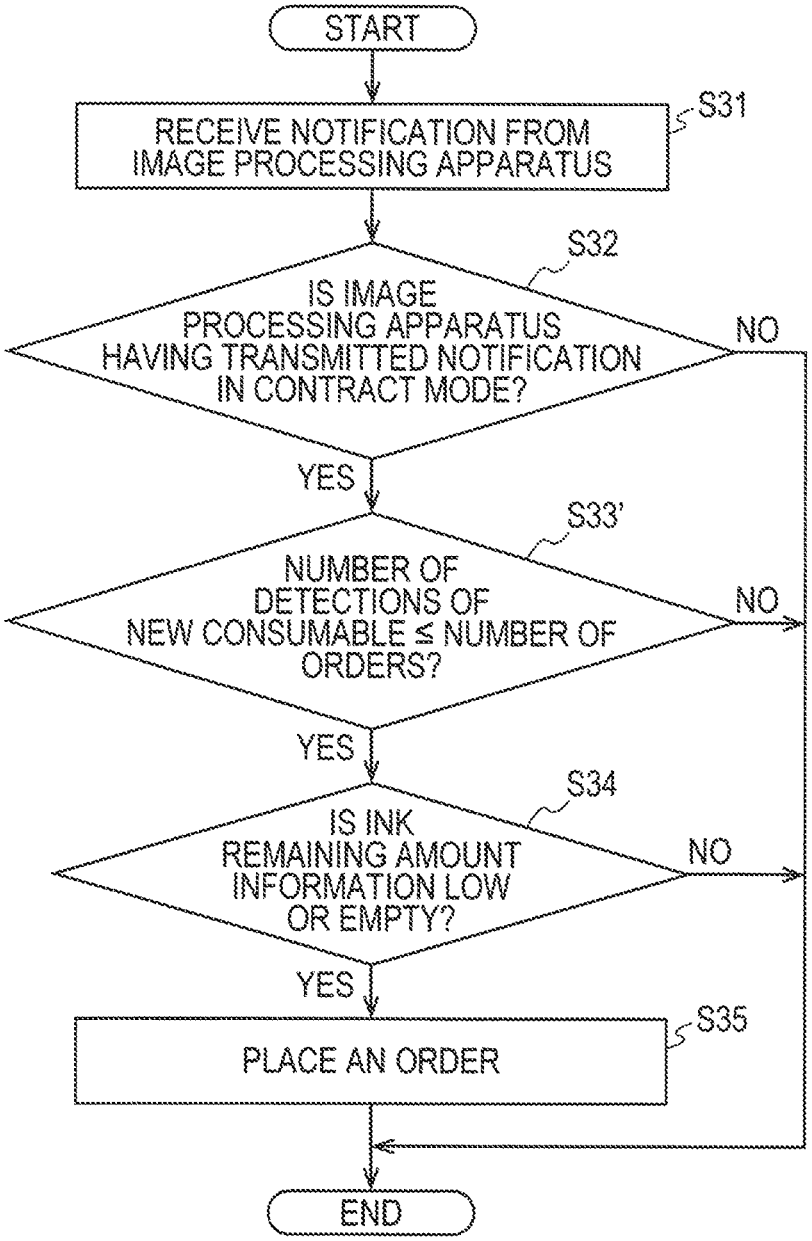
FIG. 11 is a flowchart showing an example of the flow of order processing by a management server according to a second embodiment.

FIG. 11 shows an example of the flow of order processing by the management server 9 of a second embodiment. Since the processing other than S33' in FIG. 11 is the same as that in FIG. 6, only S33' will be described.

In S33', the server controller 93 determines whether the condition that the value indicated by the number of detections of new consumable is smaller than or equal to the number of orders is satisfied ("the number of detections of new consumable"≤"the number of orders") by comparing the transmitted number of detections of new consumable 822 and the number of orders 922. In response to determining that the condition is satisfied (S33': YES), the order processing proceeds to S34. In response to determining that the condition is not satisfied, that is, the value indicated by the number of detections of new consumable is larger than the value indicated by the number of orders, the order processing ends.

As described above, when the number of detections of new consumable is larger than the number of orders, the server controller 93 does not place orders regardless of the ink remaining amount information.

<Suppression of Multiple Order>

With reference to FIGS. 12 and 13, suppression of multiple order by the order management system 100 according to the second embodiment will be described.

<Order Management of Comparative Example>

FIG. 12 shows an example of the flow of order management in an order management system of a comparative example. Here, as in the order management of FIG. 7, the management server 9 determines whether an order is to be placed based on only the ink remaining amount information of the contract cartridge used in the image processing apparatus 1. The notification is sent from the image processing apparatus 1 to the management server 9 either when the image processing apparatus 1 has changed from an offline state to an online state, or when a particular notification timing has come.

In the examples shown in FIGS. 12 to 15, it is assumed that the user has two image processing apparatuses 1, specifically, image processing apparatuses 1A and 1B. It is assumed that the image processing apparatus 1B has already been contracted for the service. Description that overlaps the examples of FIGS. 7 to 10 will be omitted.

In P101, the user registers the image processing apparatus 1A for a service, that is, makes a contract for the service. As a result, information regarding service registration is transmitted to the management server 9, and the management server 9 manages the image processing apparatus 1A assuming that the image processing apparatus 1A is in the contract mode. The management server 9 transmits information regarding the order of a starter kit to the order server 7 so that the starter kit is shipped to the user.

In P102, the user mounts a contract cartridge of the shipped starter kit on the image processing apparatus 1A.

In P103, the user performs printing in the image processing apparatus 1A. As a result, the ink remaining amount information stored in the image processing apparatus 1A is updated.

In P104, since the particular notification timing has come, the image processing apparatus 1A transmits the ink remaining amount information to the management server 9. In P104, since the ink remaining amount information is "Full", no order is placed.

In P105, the user performs printing in the image processing apparatus 1A. As a result, the ink remaining amount information stored in the image processing apparatus 1A is updated.

In P106, since the particular notification timing has come, the image processing apparatus 1A transmits the ink remaining amount information to the management server 9. In P106, since the ink remaining amount information is "Low", the management server 9 orders a contract cartridge. Hereinafter, the contract cartridge ordered in P106 will be referred to as a contract cartridge 4A.

In P107, the user mounts the contract cartridge 4A on the image processing apparatus 1A.

In P108, the user performs printing in the image processing apparatus 1A. As a result, the ink remaining amount information of the contract cartridge 4A stored in the image processing apparatus 1A is updated.

In P109, it is assumed that the user has mounted a new contract cartridge 4B shipped for the image processing apparatus 1B on the image processing apparatus 1A.

In P110, the user performs printing in the image processing apparatus 1A. As a result, the ink remaining amount information of the contract cartridge 4B stored in the image processing apparatus 1A is updated.

In P111, since the particular notification timing has come, the image processing apparatus 1A transmits the ink remaining amount information to the management server 9. In P111, since the ink remaining amount information is "Low", the management server 9 orders a contract cartridge. As a result, the user has the contract cartridge 4A ordered in P106 and a new contract cartridge. In this way, in the order management system of the comparative example, multiple order may occur.

<Order Management According to Second Embodiment>

FIG. 13 shows an example of the flow of order management in the order management system 100 according to the second embodiment. In FIG. 13, a "number of detections of new consumable" column is added to FIG. 12. The "number of detections of new consumable" column shows the number of detections of new consumable 822 at that time.

In P121, the user registers the image processing apparatus 1A for a service, that is, makes a contract for the service. As a result, information regarding service registration is transmitted to the management server 9, and the management server 9 manages the image processing apparatus 1A assuming that the image processing apparatus 1A is in the contract mode. The management server 9 transmits information regarding the order of a starter kit to the order server 7 so that the starter kit is shipped to the user. As a result, the number of orders 922 becomes "1".

In P122, the user mounts a contract cartridge of the shipped starter kit on the image processing apparatus 1A. As a result, the image processing apparatus 1A increments the number of detections of new consumable 822, and the number of detections of new consumable 822 becomes "1". The image processing apparatus 1A transmits the contract ink information 821 and the number of detections of new consumable 822 to the management server 9. In P122, although the condition that "number of detections of new consumable" is smaller than or equal to "number of orders" is satisfied, since the ink remaining amount information is "Full", no order is placed.

In P123, the user performs printing in the image processing apparatus 1A. As a result, the ink remaining amount information stored in the image processing apparatus 1A is updated.

In P124, since the particular notification timing has come, the image processing apparatus 1A transmits the contract ink information 821 and the number of detections of new consumable 822 to the management server 9. In P124, although the condition that "number of detections of new consumable" is smaller than or equal to "number of orders" is satisfied, since the ink remaining amount information is "Full", no order is placed.

In P125, the user performs printing in the image processing apparatus 1A. As a result, the ink remaining amount information stored in the image processing apparatus 1A is updated.

In P126, since the particular notification timing has come, the image processing apparatus 1A transmits the contract ink information 821 and the number of detections of new consumable 822 to the management server 9. In P126, since the condition that "number of detections of new consumable" is smaller than or equal to "number of orders" is satisfied and the ink remaining amount information is "Low", the management server 9 orders a contract cartridge. As a result, the number of orders 922 becomes "2". Hereinafter, the contract cartridge ordered in P126 is referred to as a contract cartridge 4A.

In P127, the user mounts the contract cartridge 4A on the image processing apparatus 1A. As a result, the image processing apparatus 1A increments the number of detections of new consumable 822, and the number of detections of new consumable 822 becomes "2". The image processing apparatus 1A transmits the contract ink information 821 and the number of detections of new consumable 822 to the management server 9. In P127, although the condition that "number of detections of new consumable" is smaller than or equal to "number of orders" is satisfied, since the ink remaining amount information is "Full", no order is placed.

In P128, the user performs printing in the image processing apparatus 1A. As a result, the ink remaining amount information of the contract cartridge 4A stored in the image processing apparatus 1A is updated.

In P129, it is assumed that the user has mounted, on the image processing apparatus 1A, a new contract cartridge 4B shipped for another image processing apparatus 1B. As a result, the image processing apparatus 1A increments the number of detections of new consumable 822, and the number of detections of new consumable 822 becomes "3". The image processing apparatus 1A transmits the contract ink information 821 and the number of detections of new consumable 822 to the management server 9. In P129, since the condition that "number of detections of new consumable" is smaller than or equal to "number of orders" is not satisfied, no order is placed.

In P130, the user performs printing in the image processing apparatus 1A. As a result, the ink remaining amount information of the contract cartridge 4B stored in the image processing apparatus 1A is updated.

In P131, since the particular notification timing has come, the image processing apparatus 1A transmits the contract ink information 821 and the number of detections of new consumable 822 to the management server 9. In P131, since the condition that "number of detections of new consumable" is smaller than or equal to "number of orders" is not satisfied, no order is placed.

In P132, it is assumed that the user has mounted the contract cartridge 4A on the image processing apparatus 1A again. As a result, the image processing apparatus 1A transmits the contract ink information 821 and the number of detections of new consumable 822 to the management server 9. In P132, since the condition that "number of detections of new consumable" is smaller than or equal to "number of orders" is not satisfied, no order is placed.

As described above, the order management system 100 according to the second embodiment does not order a contract cartridge when the number of detections of new consumable is larger than the number of orders. As a result, multiple order does not occur even if the user uses the contract cartridge of another image processing apparatus 1 without using the contract cartridge of a certain image processing apparatus 1, that is, in a situation where multiple order can occur.

<Suppression of Order Omission>

With reference to FIGS. 14 and 15, the suppression of order omission by the order management system 100 according to the second embodiment will be described.

<Order Processing of Comparative Example>

FIG. 14 shows an example of the flow of order management in the order management system of a comparative example. P141 to P149 of FIG. 14 are the same as P41 to P49 of FIG. 9 except that the image processing apparatus 1 is replaced with the image processing apparatus 1A. Thus, detailed description of P141 to P149 will be omitted.

<Order Management According to Second Embodiment>

FIG. 15 shows an example of the flow of order management in the order management system 100 according to the second embodiment. In FIG. 15, a "number of detections of new consumable" column is added to FIG. 14.

In P151, the user registers the image processing apparatus 1A for a service, that is, makes a contract for the service. As a result, information regarding service registration is transmitted to the management server 9, and the management server 9 manages the image processing apparatus 1A assuming that the image processing apparatus 1A is in the contract mode. The management server 9 transmits information regarding the order of a starter kit to the order server 7 so that the starter kit is shipped to the user.

In P152, the user mounts a contract cartridge of the shipped starter kit on the image processing apparatus 1A. As a result, the image processing apparatus 1A increments the number of detections of new consumable 822, and the number of detections of new consumable 822 becomes "1".

The image processing apparatus 1A transmits the contract ink information 821 and the number of detections of new consumable 822 to the management server 9. In P152, although the condition that "number of detections of new consumable" is smaller than or equal to "number of orders" is satisfied, since the ink remaining amount information is "Full", no order is placed.

In P153, the user performs printing in the image processing apparatus 1A. As a result, the ink remaining amount information stored in the image processing apparatus 1A is updated.

In P154, since the particular notification timing has come, the image processing apparatus 1A transmits the contract ink information 821 and the number of detections of new consumable 822 to the management server 9. In P154, although the condition that "number of detections of new consumable" is smaller than or equal to "number of orders" is satisfied, since the ink remaining amount information is "Full", no order is placed.

In P155, the user performs printing in the image processing apparatus 1A. As a result, the ink remaining amount information stored in the image processing apparatus 1A is updated.

In P156, it is assumed that the contract ink cartridge mounted on the image processing apparatus 1A has run out of ink. In P156, the user does not have a new contract cartridge because the ink has run out before the notification timing.

In P157, the user mounts a commercial cartridge on the image processing apparatus 1A. As a result, although the used ink information 831 is updated with the information of the commercial cartridge, the contract ink information 821 retains the information of the contract cartridge that has run out of ink in P156. The image processing apparatus 1A transmits the contract ink information 821 and the number of detections of new consumable 822 to the management server 9. In P156, since the condition that "number of detections of new consumable" is smaller than or equal to "number of orders" is satisfied, and the ink remaining amount information is "Empty", the management server 9 orders a contract cartridge.

As described above, the order management system 100 according to the second embodiment transmits the contract ink information 821 at the time of notification regardless of the type of the ink cartridge 4 (that is, a contract cartridge or a commercial cartridge) mounted on the image processing apparatus 1. As a result, order omission does not occur even in a situation where order omission can occur in the order management system of the comparative example.

<Operations and Effects>

As described above, the order management system 100 according to the second embodiment includes the image processing apparatus 1 and the management server 9.

The image processing apparatus 1 is the same as that of the first embodiment. In the second embodiment, the server controller 93 performs order processing in response to receiving the number of detections of new consumable 822 and the ink remaining amount information through the server communication interface 91. In this order processing, the server controller 93 does not order the contract cartridge if the number of detections of new consumable 822 is larger than the number of orders 922 or the ink remaining amount information is "Full", and orders the contract cartridge of the ink cartridge 4 if the number of detections of new consumable 822 is smaller than or equal to the number of orders 922 and the ink remaining amount information is "Low" or "Empty".

The situation where the number of detections of new consumable 822 is larger than the number of orders 922 indicates that a contract cartridge different from the contract cartridge ordered for the image processing apparatus 1 is mounted on the image processing apparatus 1. This indicates that the user of the image processing apparatus 1 does not use, and keeps the contract cartridge ordered for the image processing apparatus 1. According to the above configuration, a condition that the number of detections of new consumable 822 is smaller than or equal to the number of orders 922 is necessary for ordering the contract cartridge. Thus, in the above situation, since the subsequent order for contract cartridge is not performed, the order mistake of the contract cartridge, specifically, the multiple order of the contract cartridge is suppressed.

When image processing is performed many times in a short period of time, there is a possibility that the mounted contract cartridge may become unusable before a particular timing at which transmission processing is performed. In this case, the user of the image processing apparatus 1 may inevitably use a commercial cartridge. In such a case, if the number of detections of new consumable 822 is incremented without distinguishing between the contract cartridge and the commercial cartridge, the transmission processing is performed in a state where the number of detections of new consumable 822 is larger than the number of orders. Thus, the contract cartridge is not ordered. On the other hand, according to the above configuration, the number of detections of new consumable 822 is incremented only when a new contract cartridge is mounted. Thus, as described above, when the user uses a commercial cartridge without malicious intent, the order is placed.

Consider a case where a contract cartridge of another image processing apparatus 1 in the contract mode is mistakenly mounted on the image processing apparatus 1 in the normal mode. At this time, if the number of detections of new consumable 822 is incremented, when the user notices an error and removes the contract cartridge and then the image processing apparatus 1 is set to the contract mode, the number of detections of new consumable 822 is incremented again by mounting the contract cartridge. As a result, the number of detections of new consumable 822 becomes larger than the number of orders 922, and subsequent orders are not performed. On the other hand, according to the above configuration, when a new contract cartridge is mounted on the image processing apparatus 1 in the normal mode, the number of detections of new consumable 822 is not incremented. Thus, in a case where the user notices an error and removes the contract cartridge and then the image processing apparatus 1 is set to the contract mode, the contract cartridge is ordered as usual.

[Modifications]

The order management system 100 may include only one of a configuration for suppressing multiple orders and a configuration for suppressing order omission.

When only the former configuration is provided, the image processing apparatus 1 may have a configuration that does not include the first memory 82. In this example, the image processing apparatus 1 does not store the contract ink information 821, and stores the number of detections of new consumable 822 in the second memory 83. The controller 80 transmits the used ink information 831 and the number of detections of new consumable 822 to the management server 9 at the notification timing to the management server 9.

When only the latter configuration is provided, the image processing apparatus 1 may have a configuration that does not store the number of detections of new consumable 822.

In this example, the controller 80 transmits the contract ink information 821 to the management server 9 at the notification timing to the management server 9. When the ink remaining amount information of the contract ink information 821 is "Low" or "Empty", the server controller 93 of the management server 9 orders the contract cartridge.

The image processing apparatus 1 may transmit the used ink information 831 in addition to the contract ink information 821 and the number of detections of new consumable 822 at the notification timing to the management server 9. In this example, the server controller 93 also uses the contract ink information 821 to determine whether to order the contract cartridge.

In the above embodiment, the example in which the consumable is an ink cartridge has been described, but the consumable of the image processing apparatus 1 is not limited to the ink cartridge. In the example in which the image processing apparatus 1 is an inkjet printer, the consumable may include a consumable other than the ink cartridge 4. In the example where the image processing apparatus 1 is a laser printer, the consumable may include a toner cartridge instead of the ink cartridge 4. When the consumable includes a consumable other than the ink cartridge 4 and the above-mentioned toner cartridge, the information indicating the life of the consumable is not limited to information indicating a remaining amount. The information may be, for example, the useful life of the consumable, the number of pages of printing paper used for printing, and the number of rotations of the consumable in a case where the consumable is a rotating body.

In the above embodiment, the example has been described in which the order management system 100 manages the order of the contract cartridge which is the ink cartridge dedicated to contract. However, the consumable for which the order management system 100 manages the order is not limited to the consumable dedicated to contract. The consumable may be, for example, a consumable that is usable in both the image processing apparatus 1 in the contract mode and the image processing apparatus 1 in the normal mode.

In this case, the controller 80 does not determine whether the mounted consumable is a consumable dedicated to contract, that is, the controller 80 does not execute the processing in S3 in FIG. 3.

In the above embodiment, the contract ink information 821 is stored in the first memory 82, and the used ink information 831 is stored in the second memory 83 which is a memory different from the first memory 82. However, the memory for storing these information is not limited to this example. The image processing apparatus 1 only need to store the contract ink information 821 and the used ink information 831 separately. For example, the contract ink information 821 may be stored in a first area of a memory of the image processing apparatus 1, and the used ink information 831 may be stored in a second area different from the first area.

The number of detections of new consumable 822 is stored in the first memory 82 in the above embodiment, but may be stored in the second memory 83.

When a certain image processing apparatus 1 changes from the contract mode to the normal mode, the server controller 93 of the management server 9 may execute number-of-order initialization processing for initializing the number of orders 922 of the image processing apparatus 1. In this example, the controller 80 of the image processing apparatus 1 may execute number-of-mounting initialization processing for initializing the number of detections of new consumable 822.

In a case where the number of orders 922 stored in the management server 9 is initialized and the number of detections of new consumable 822 stored in the image processing apparatus 1 is not initialized, when the image processing apparatus 1 becomes the contract mode again, the number of detections of new consumable 822 becomes larger than the number of orders 922. Thus, depending on the above-mentioned first condition and second condition, the contract cartridge may or may not be ordered. Or, the contract cartridge is not ordered thereafter. According to the above configuration, the number of orders 922 stored in the management server 9 is initialized, and the number of detections of new consumable 822 stored in the image processing apparatus 1 is initialized. As a result, when the image processing apparatus 1 becomes the contract mode again, the contract cartridge is ordered as usual.

The memory of the image processing apparatus 1 may store the history of the ink cartridges 4 mounted in the past. The history may be, for example, information indicating the ink ID 421 of the ink cartridge 4 mounted immediately before the ink cartridge 4 that is currently mounted, or information in which the ink IDs 421 of the ink cartridges 4 mounted in the past are stored in chronological order. In the latter example, the number of ink IDs 421 included in the history is not limited to a particular number.

In the above embodiment, in determination of whether to send notification to the management server 9, the controller 80 determines (1) whether the ink cover is closed, (2) whether the image processing apparatus 1 has changed from an offline state to an online state, and (3) whether it is a particular notification timing. Alternatively, the controller 80 may be configured to determine at least one of the above (1) to (3).

In the above embodiment, the controller 80 sends notification to the management server 9 when the ink cover is closed. In this regard, the controller 80 may send notification to the management server 9 at any timing within the period from when a new contract cartridge is mounted on the image processing apparatus 1 until the image processing apparatus 1 becomes ready to perform image processing. That is, the timing of notification is not limited to the timing when the ink cover is closed, and may be the timing when the contract cartridge is mounted or the timing when printing becomes possible after the ink cover is closed, for example.

In the above embodiment, the server controller 93 determines whether the transmitted ink remaining amount information is "Low" or "Empty". However, the determination regarding the ink remaining amount information is not limited to this example. For example, the server controller 93 may determine whether the transmitted ink remaining amount information is "Empty". In this example, when the transmitted ink remaining amount information is "Full" or "Low", the contract cartridge is not ordered.

The ink remaining amount information of the contract ink information 821 and the used ink information 831 may further include ratio information indicating the remaining amount as a ratio to the maximum value. In this example, the controller 80 includes any one of "Full", "Low", and "Empty" and the ratio information as the ink remaining amount information.

Regarding the contract cartridge sent to the user, the management server 9 may predict the date when the ink remaining amount information becomes a particular value or less and store the date in the server memory 92 in association with the ink ID 421. The date may be, for example, a date on which the ratio information becomes "0 percent". In this example, in a case where conditions (1) and (2) are satisfied where (1) it is less than 10 days until the predicted date and (2) the ratio indicated by the transmitted ratio information is smaller than the particular value, the server controller 93 may order the contract cartridge even if the ink remaining amount information is "Full". The particular value in "the ratio is smaller than the particular value" may be 51 percent, for example.

In the above embodiment, the management server 9 and the order server 7 are separate servers. Alternatively, the management server 9 and the order server 7 may be configured as one server.

[Example of Realization by Software]

The control blocks of the image processing apparatus 1 and the management server 9 may be realized by a logic circuit (hardware) formed in an integrated circuit (IC chip) and so on, or may be realized by software.

In the latter case, the image processing apparatus 1 and the management server 9 include a computer that executes instructions of a program which is software that realizes each function. The computer includes, for example, one or more processors and a computer-readable storage medium that stores the program. In the computer, the processor reads the program from the storage medium and executes the program, thereby achieving the object of this disclosure. As the processor, for example, a CPU (Central Processing Unit) may be used.

As the storage medium, a non-transitory tangible medium", for example, a ROM (Read Only Memory) and so on, a tape, a disk, a card, a semiconductor memory, a programmable logic circuit, and so on may be used. A RAM (Random Access Memory) for expanding the above program may be further provided. The program may be supplied to the computer through an arbitrary transmission medium (communication network, broadcast wave, and so on) capable of transmitting the program.

One aspect of this disclosure may also be realized in the form of a data signal embedded in a carrier wave in which the program is embodied by electronic transmission.

While the disclosure has been described in detail with reference to the above aspects thereof, it would be apparent to those skilled in the art that various changes and modifications may be made therein without departing from the scope of the claims. The scope of this disclosure also includes embodiments obtained by appropriately combining the technical means disclosed in the embodiments.

What is claimed is:

1. A system comprising:

an image processing apparatus; and a server connected to the image processing apparatus through a network so as to perform communication with the image processing apparatus, the server being configured to provide a service of managing a consumable used in the image processing apparatus, the image processing apparatus including:

an image processing device configured to perform image processing by using the consumable mounted on the image processing apparatus;

an apparatus interface for connecting to the network;

an apparatus memory configured to store a number of mounting of a new consumable, the new consumable being an unused consumable; and an apparatus controller configured to perform:

updating the number of mounting stored in the apparatus memory when the new consumable is mounted on the image processing apparatus;

transmitting, at a particular timing, the number of mounting stored in the apparatus memory through the apparatus interface to the server, the server including:

a server interface for connecting to the network;

a server memory configured to store a number of orders of the new consumable; and a server controller configured to perform:

in response to receiving, through the server interface, the number of mounting, not placing an order for the new consumable when the number of mounting is larger than the number of orders, and placing the order for the new consumable when the number of mounting is smaller than or equal to the number of orders; and when the order is placed, updating the number of orders stored in the server memory.

2. The system according to claim 1, wherein the particular timing includes a timing within a period from when the consumable is mounted on the image processing apparatus until the image processing apparatus becomes ready to execute the image processing.

3. The system according to claim 1, wherein the apparatus controller is configured to further perform determining whether the image processing apparatus is contracted for the service; and wherein the apparatus controller is configured to:

update the number of mounting in response to determining that the new consumable is mounted on the image processing apparatus and that the image processing apparatus is contracted for the service; and not update the number of mounting in response to determining that the image processing apparatus is not contracted for the service.

4. The system according to claim 1, wherein the server controller is configured to, when the image processing apparatus changes from a contract mode for the service to a non-contract mode for the service, initialize the number of orders stored in the server memory; and wherein the apparatus controller is configured to, when the image processing apparatus changes from the contract mode for the service to the non-contract mode for the service, initialize the number of mounting stored in the apparatus memory.

5. The system according to claim 1, wherein the apparatus memory is configured to further store a life of the consumable mounted on the image processing apparatus;

wherein the apparatus controller is configured to perform:

updating the life stored in the apparatus memory in response to execution of the image processing; and wherein the server controller is configured to perform:

in response to receiving, through the server interface, the number of mounting and the life, not placing the order for the new consumable when the number of mounting is larger than the number of orders or the life is longer than or equal to a particular value, and placing the order for the new consumable when the number of mounting is smaller than or equal to the number of orders and the life is shorter than the particular value.

6. The system according to claim 5, wherein the image processing apparatus is configured such that a managed consumable managed by the server and an unmanaged consumable not managed by the server are mountable thereon as the consumable;

wherein the server controller is configured to place the order based on the life of the managed consumable without placing the order based on the life of the unmanaged consumable; and wherein the apparatus controller is configured to, when transmitting the life to the server, transmit at least the life of the managed consumable.

7. The system according to claim 6, wherein the apparatus controller is configured to:

when a consumable currently mounted on the image processing apparatus is the managed consumable, update the life stored in a first area of the apparatus memory and the life stored in a second area of the apparatus memory, the second area being different from the first area; and when the consumable currently mounted on the image processing apparatus is the unmanaged consumable, update the life stored in the second area without updating the life stored in the first area; and wherein the apparatus controller is configured to, when transmitting the life to the server, transmit at least the life stored in the first area.

8. The system according to claim 6, wherein the apparatus controller is configured to further perform determining whether the managed consumable is mounted; and wherein the apparatus controller is configured to:

update the number of mounting in response to determining that the new consumable is mounted on the image processing apparatus and that the managed consumable is mounted; and not update the number of mounting in response to determining that the unmanaged consumable is mounted.

9. A server configured to provide a service of managing a consumable used in an image processing apparatus, the server comprising:

an interface for connecting to the image processing apparatus through a network so as to perform communication with the image processing apparatus;

a memory configured to store a number of orders of a new consumable, the new consumable being an unused consumable; and a controller configured to perform:

in response to receiving, through the interface, a number of mounting of the new consumable on the image processing apparatus transmitted from the image processing apparatus, not placing an order for the new consumable when the number of mounting is larger than the number of orders, and placing the order for the new consumable when the number of mounting is smaller than or equal to the number of orders; and when the order is placed, updating the number of orders stored in the memory.

10. The server according to claim 9, wherein the controller is configured to perform:

in response to receiving, through the interface, the number of mounting of the new consumable on the image processing apparatus and a life of the consumable mounted on the image processing apparatus transmitted from the image processing apparatus, not placing the order for the new consumable when the number of mounting is larger than the number of orders or the life is longer than or equal to a particular value, and placing the order for the new consumable when the number of mounting is smaller than or equal to the number of orders and the life is shorter than the particular value.

11. A system comprising:

an image processing apparatus; and a server connected to the image processing apparatus through a network so as to perform communication with the image processing apparatus, the server being configured to provide a service of managing a consumable used in the image processing apparatus, the consumable including a managed consumable managed by the server and an unmanaged consumable not managed by the server, the server including:

a server interface for connecting to the network; and a server controller configured not to place an order of the managed consumable based on a life of the unmanaged consumable and to place the order of the managed consumable based on a life of the managed consumable, the image processing apparatus including:

an image processing device configured to perform image processing by using the consumable mounted on the image processing apparatus;

an apparatus interface for connecting to the network;

an apparatus memory configured to store the life of the consumable mounted on the image processing apparatus; and an apparatus controller configured to perform:

when the managed consumable is mounted on the image processing apparatus, updating the life of the managed consumable stored in the apparatus memory in response to execution of the image processing; and transmitting, at a particular timing, at least the life of the managed consumable stored in the apparatus memory through the apparatus interface to the server.

12. An image processing apparatus configured such that a managed consumable managed by a server and an unmanaged consumable not managed by the server are mountable thereon as a consumable, the image processing apparatus comprising:

an interface for connecting to the server so as to perform communication with the server;

an image processing device configured to perform image processing by using the consumable mounted on the image processing apparatus;

a memory configured to store a life of the consumable mounted on the image processing apparatus; and a controller configured to perform:

when the managed consumable is mounted on the image processing apparatus, updating the life of the managed consumable stored in the memory in response to execution of the image processing; and transmitting, at a particular timing, at least the life of the managed consumable stored in the memory through the interface to the server.

13. A system comprising:

an image processing apparatus; and a server connected to the image processing apparatus through a network so as to perform communication with the image processing apparatus, the server being configured to provide a service of managing a consumable used in the image processing apparatus, the image processing apparatus including:

an image processing device configured to perform image processing by using the consumable mounted on the image processing apparatus;

an apparatus interface for connecting to the network;

an apparatus memory configured to store a number of mounting of a new consumable, the new consumable being an unused consumable; and an apparatus controller configured to perform:

updating the number of mounting stored in the apparatus memory when the new consumable is mounted on the image processing apparatus;

transmitting, at a particular timing, the number of mounting stored in the apparatus memory through the apparatus interface to the server, the server including:

a server interface for connecting to the network;

a server memory configured to store a number of orders of the new consumable; and a server controller configured to perform:

in response to receiving, through the server interface, the number of mounting transmitted from the image processing apparatus, not placing an order for the new consumable when a magnitude relationship between the number of mounting and the number of orders satisfies a first condition, and placing the order for the new consumable when the magnitude relationship satisfies a second condition different from the first condition; and when the order is placed, updating the number of orders stored in the server memory.

14. The system according to claim 13, wherein the first condition is that the number of mounting is smaller than the number of orders; and wherein the second condition is that the number of mounting is larger than or equal to the number of orders.

15. The system according to claim 13, wherein the first condition is that the number of mounting is different from the number of orders; and wherein the second condition is that the number of mounting is equal to the number of orders.

16. The system according to claim 13, wherein the particular timing includes a timing within a period from when the consumable is mounted on the image processing apparatus until the image processing apparatus becomes ready to execute the image processing.

17. The system according to claim 13, wherein the apparatus controller is configured to further perform determining whether the image processing apparatus is contracted for the service; and wherein the apparatus controller is configured to:

update the number of mounting in response to determining that the new consumable is mounted on the image processing apparatus and that the image processing apparatus is contracted for the service; and not update the number of mounting in response to determining that the image processing apparatus is not contracted for the service.

18. The system according to claim 13, wherein the server controller is configured to, when the image processing apparatus changes from a contract mode for the service to a non-contract mode for the service, initialize the number of orders stored in the server memory; and wherein the apparatus controller is configured to, when the image processing apparatus changes from the contract mode for the service to the non-contract mode for the service, initialize the number of mounting stored in the apparatus memory.

19. The system according to claim 13, wherein the apparatus memory is configured to further store a life of the consumable mounted on the image processing apparatus;

wherein the apparatus controller is configured to perform:

updating the life stored in the apparatus memory in response to execution of the image processing; and wherein the server controller is configured to perform:

in response to receiving, through the server interface, the number of mounting and the life transmitted from the image processing apparatus, not placing the order for the new consumable when the magnitude relationship between the number of mounting and the number of orders satisfies the first condition or the life is longer than or equal to a particular value, and placing the order for the new consumable when the magnitude relationship satisfies the second condition different from the first condition and the life is shorter than the particular value.

20. The system according to claim 19, wherein the image processing apparatus is configured such that a managed consumable managed by the server and an unmanaged consumable not managed by the server are mountable thereon as the consumable;

wherein the server controller is configured to place the order based on the life of the managed consumable without placing the order based on the life of the unmanaged consumable; and wherein the apparatus controller is configured to, when transmitting the life to the server, transmit at least the life of the managed consumable.

21. The system according to claim 20, wherein the apparatus controller is configured to:

when a consumable currently mounted on the image processing apparatus is the managed consumable, update the life stored in a first area of the apparatus memory and the life stored in a second area of the apparatus memory, the second area being different from the first area; and when the consumable currently mounted on the image processing apparatus is the unmanaged consumable, update the life stored in the second area without updating the life stored in the first area; and wherein the apparatus controller is configured to, when transmitting the life to the server, transmit at least the life stored in the first area.

22. The system according to claim 20, wherein the apparatus controller is configured to further perform determining whether the managed consumable is mounted; and wherein the apparatus controller is configured to:

update the number of mounting in response to determining that the new consumable is mounted on the image processing apparatus and that the managed consumable is mounted; and not update the number of mounting in response to determining that the unmanaged consumable is mounted.

23. A server configured to provide a service of managing a consumable used in an image processing apparatus, the server comprising:

an interface for connecting to the image processing apparatus through a network so as to perform communication with the image processing apparatus;

a memory configured to store a number of orders of a new consumable, the new consumable being an unused consumable; and a controller configured to perform:

in response to receiving, through the interface, a number of mounting of the new consumable on the image processing apparatus transmitted from the image processing apparatus, not placing an order for the new consumable when a magnitude relationship between the number of mounting and the number of orders satisfies a first condition, and placing the order for the new consumable when the magnitude relationship satisfies a second condition different from the first condition; and when the order is placed, updating the number of orders stored in the memory.

24. The server according to claim 23, wherein the controller is configured to perform:

in response to receiving, through the interface, the number of mounting of the new consumable on the image processing apparatus and a life of the consumable mounted on the image processing apparatus transmitted from the image processing apparatus, not placing the order for the new consumable when the magnitude relationship between the number of mounting and the number of orders satisfies the first condition or the life is longer than or equal to a particular value, and placing the order for the new consumable when the magnitude relationship satisfies the second condition different from the first condition and the life is shorter than the particular value.

* * * * *